US007413026B2

(12) United States Patent
Berghauser et al.

(10) Patent No.: US 7,413,026 B2
(45) Date of Patent: Aug. 19, 2008

(54) LUBRICANT SYSTEM FOR POWERED HAMMER

(75) Inventors: Ulrich Berghauser, Diethardt (DE); Andreas Friedrich, Lumburg (DE); Frantisek Harcar, Lipany (SK)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/823,208

(22) Filed: Jun. 27, 2007

(65) Prior Publication Data

US 2008/0006420 A1 Jan. 10, 2008

(30) Foreign Application Priority Data

Jul. 1, 2006 (GB) ..... 0613181.7
Jul. 5, 2006 (GB) ..... 0613321.9
Jul. 5, 2006 (GB) ..... 0613323.5

(51) Int. Cl.
*B25D 17/24* (2006.01)

(52) U.S. Cl. ..... 173/76; 173/80; 173/109; 173/201

(58) Field of Classification Search ..... 173/109, 173/201, 48, 216, 210, 212, 78, 80, 197, 173/162.1, 76, 90
See application file for complete search history.

(56) References Cited

U.S. PATENT DOCUMENTS 137,514 A 3/1873 Vogler
1,076,246 A 10/1913 Smith
1,470,622 A 10/1923 Jimerson
(Continued)

FOREIGN PATENT DOCUMENTS

AU 749893 B 7/2002
(Continued)

*Primary Examiner*—Scott A. Smith
(74) *Attorney, Agent, or Firm*—Scott B. Markow; Adan Ayala

(57) ABSTRACT

A powered hammer includes a housing, a tool holder coupled to the housing and configured to hold a tool, a motor within the housing, a cylinder disposed within the housing, and a piston slideably mounted within the cylinder. A drive mechanism converts rotary output of the motor into a reciprocating motion of the piston. The drive mechanism includes a crank shaft rotationally driven by the motor, a drive pin eccentrically mounted on the crank shaft, and a con rod with a first end connected to the drive pin and a second end connected to the piston. A ram is slideably mounted forward of the piston that is reciprocatingly driven by the piston. A beat piece is slideably mounted forward of the ram. The beat piece is repetitively struck by the reciprocating ram, which in turn repetitively strikes an end of the tool when held in the tool holder to transfer the momentum of the ram to the tool. Lubrication fluid covers at least part of the drive mechanism. A rear piston chamber is formed within an end of the cylinder, rearward of the piston, the volume of which repetitively changes as the piston moves within the cylinder, causing air within the housing to be at least one of drawn into and blown out of the rear piston chamber. The movement of air causes the lubrication fluid to move within the housing. A longitudinal passageway defined in at least one of the crank shaft and the drive pin enables passage of air and the lubricating fluid to assist in movement of the lubrication fluid within the housing.

16 Claims, 23 Drawing Sheets

U.S. PATENT DOCUMENTS 1,668,830 A 5/1928 Stevens
1,694,559 A 12/1928 Osgood
1,800,465 A 4/1931 Miller et al.
1,827,877 A 10/1931 Meeker et al.
1,887,762 A 11/1932 Horton
1,901,779 A 3/1933 Skeel et al.
1,905,981 A 4/1933 Curtis
2,049,366 A 7/1936 Gardner
2,062,817 A 12/1936 Noble
2,152,681 A 4/1939 Caminez
2,230,046 A 1/1941 Curtis
2,251,701 A 8/1941 Dixon
D134,504 S 12/1942 Curtis
RE23,104 E 4/1949 Price
2,533,487 A 12/1950 Maurer et al.
2,622,562 A 12/1952 Longenecker
2,629,364 A 2/1953 Anderson
2,630,784 A 3/1953 Wallerstein, Jr.
2,677,355 A 5/1954 Maurer et al.
2,737,264 A 3/1956 Klaucke
2,795,325 A 6/1957 Smith
2,846,280 A 8/1958 Berg
2,906,244 A 9/1959 Christensen
2,925,283 A 2/1960 Stilger
2,932,523 A 4/1960 Dey
2,984,210 A 5/1961 Fuehrer
3,000,225 A 9/1961 Taylor
3,022,769 A 2/1962 Amundsen et al.
3,046,958 A 7/1962 Bard et al.
3,063,508 A 11/1962 Henry
3,118,685 A 1/1964 Jordan
3,119,274 A 1/1964 Short
3,132,702 A 5/1964 Schrum, Sr. et al.
3,156,943 A 11/1964 Groomer et al.
3,162,268 A 12/1964 Short
3,179,185 A 4/1965 O'Farrell
3,303,892 A 2/1967 Nishimura et al.
3,369,614 A 2/1968 Anthony
3,390,889 A 7/1968 Grover
3,481,649 A 12/1969 Ericsson
3,730,020 A 5/1973 Di Matteo, Sr. et al.
3,777,848 A 12/1973 Schaeffer et al.
3,804,541 A 4/1974 Pitner
3,822,001 A 7/1974 Sides
3,824,417 A 7/1974 Moores, Jr.
3,892,280 A 7/1975 Klushin et al.
3,943,587 A 3/1976 Lasky
3,960,252 A 6/1976 Cassimally
4,036,085 A 7/1977 Sjostrand et al.
4,074,776 A 2/1978 Schnell
4,077,508 A 3/1978 Pedersen
4,183,414 A 1/1980 Tamai et al.
4,196,908 A 4/1980 Rose et al.
4,381,037 A 4/1983 Cuneo
4,440,237 A 4/1984 Casperovich
4,452,289 A 6/1984 Smith
4,493,490 A 1/1985 Ohma
4,548,278 A 10/1985 Gidlund
4,550,931 A 11/1985 Ziaylek, Jr.
4,602,689 A 7/1986 Wanner
4,673,043 A 6/1987 Greppmair
4,743,038 A 5/1988 Myers et al.
4,758,100 A 7/1988 Guttinger
4,936,394 A 6/1990 Ohtsu
4,940,341 A 7/1990 Schuetz et al.
4,956,888 A 9/1990 Green
D319,960 S 9/1991 Johansson
5,050,687 A 9/1991 Prokhorov et al.
5,052,498 A 10/1991 Gustafsson et al.
5,052,500 A 10/1991 Ohtsu
5,083,499 A 1/1992 Elvingsson
5,159,814 A 11/1992 Jakobsson
D335,619 S 5/1993 Ogawa et al.
5,333,886 A 8/1994 Sanders
5,362,170 A 11/1994 Fevre
5,363,835 A 11/1994 Robson
5,441,192 A 8/1995 Sugita et al.
5,462,127 A 10/1995 Svensson
5,467,689 A 11/1995 Carlin et al.
5,740,586 A 4/1998 Gomas
5,749,421 A 5/1998 Johansson et al.
5,775,196 A 7/1998 Henriksson
5,775,440 A * 7/1998 Shinma ..... 173/109
5,871,059 A 2/1999 Shibata et al.
5,893,419 A 4/1999 Hodges
5,944,118 A 8/1999 Johansson et al.
5,987,718 A 11/1999 Kelly
5,996,708 A 12/1999 Gerold
6,076,616 A * 6/2000 Kramp et al. ..... 173/162.2
6,078,238 A 6/2000 Gerold
6,119,795 A 9/2000 Lee
6,146,073 A 11/2000 Kobusch
6,170,579 B1 * 1/2001 Wadge ..... 173/216
6,237,699 B1 5/2001 Plietsch et al.
6,467,555 B2 10/2002 Plank et al.
6,644,418 B2 11/2003 Haga
6,666,284 B2 12/2003 Stirm
6,679,411 B2 1/2004 Popovich et al.
6,763,897 B2 7/2004 Hanke et al.
6,808,026 B2 10/2004 Berger et al.
6,945,145 B1 9/2005 Kesinger
6,990,390 B2 1/2006 Groth et al.
7,096,973 B2 8/2006 Ikuta et al.
7,121,360 B2 10/2006 Funfer
7,204,322 B2 * 4/2007 Sakai ..... 173/162.1
7,258,173 B2 * 8/2007 Hammerstingl et al. ..... 173/201
7,331,407 B2 * 2/2008 Stirm et al. ..... 173/201
7,331,408 B2 * 2/2008 Arich et al. ..... 173/201
2002/0134563 A1 9/2002 Stirm
2002/0185288 A1 12/2002 Hanke et al.
2003/0146007 A1 8/2003 Greitmann
2003/0221847 A1 12/2003 Funfer
2004/0222001 A1 11/2004 Ikuta et al.
2004/0231867 A1 11/2004 Becht et al.
2005/0034881 A1 2/2005 Berger et al.
2005/0082073 A1 4/2005 Funfer
2005/0173140 A1 8/2005 Oda et al.
2006/0054012 A1 3/2006 Baumann et al.
2007/0017684 A1 1/2007 Stirm et al.

FOREIGN PATENT DOCUMENTS

AU 2005210312 8/2005
DE 847580 8/1952
DE 1208234 12/1965
DE 7015518 8/1970
DE 1628059 12/1970
DE 2020962 11/1972
DE 2260365 12/1972
DE 2335924 2/1975
DE 2511044 9/1976
DE 2557203 11/1976
DE 2804665 8/1978
DE 2743153 4/1979
DE 7740184 U 4/1979
DE 2912280 10/1980
DE 2945935 5/1981
DE 3010479 10/1981
DE 3131639 3/1983
DE 3441051 5/1986
DE 3910599 10/1990
DE 4134918 1/1993
DE 19804919 8/1999
DE 10201895 8/2002

| | | |
|---|---|---|
| DE | 10163278 | 7/2003 |
| DE | 202004020770 | 3/2004 |
| DE | 10348514 | 2/2005 |
| DE | 102004043831 | 3/2006 |
| EP | 0055244 | 6/1982 |
| EP | 0760732 | 3/1997 |
| EP | 0882510 | 12/1998 |
| EP | 0983445 | 3/2000 |
| EP | 1157788 | 11/2001 |
| EP | 1252976 | 10/2002 |
| EP | 1475190 | 11/2004 |
| EP | 1714747 | 10/2006 |
| GB | 03586/13 | 3/1931 |
| GB | 605466 | 7/1948 |
| GB | 969007 | 9/1964 |
| GB | 1426770 | 3/1976 |
| GB | 1504545 | 3/1978 |
| GB | 2053768 | 2/1981 |
| GB | 2063141 | 6/1981 |
| GB | 2072080 | 9/1981 |
| GB | 1601264 | 10/1981 |
| GB | 2334053 | 8/1999 |
| GB | 2373276 | 9/2002 |
| GB | 2418390 | 3/2006 |
| GB | 2421000 | 6/2006 |
| JP | 2004167639 | 6/2004 |
| WO | WO 03/041915 | 5/2003 |
| WO | WO 2006/061385 A1 | 6/2006 |
| WO | WO 2006/061389 A1 | 6/2006 |

* cited by examiner 502
522
524
528
402

522
Q
524
502
402
404
540
400

LUBRICANT SYSTEM FOR POWERED HAMMER

CROSS REFERENCE TO RELATED APPLICATIONS

This application claims priority, under 35 U.S.C. § 119(a)-(d), to UK Patent Application No. GB 06 131 81.7, filed Jul. 1, 2006, UK Patent Application No. GB 06 133 21.9, filed Jul. 5, 2006, and UK Patent Application No. GB 06 133 23.5, filed Jul. 5, 2006, each of which is incorporated herein by reference.

TECHINCAL FIELD OF THE INVENTION

This application relates to a lubricant system powered hammer, such as a hammer drill or a pavement breaker.

BACKGROUND

A powered hammer, such as a hammer drill often has three modes of operation. Such a hammer drill typically comprises a spindle mounted for rotation within a housing which can be selectively driven by a rotary drive arrangement within the housing. The rotary drive arrangement is driven by a motor also located within the housing. The spindle rotatingly drives a tool holder of the hammer drill which in turn rotatingly drives a cutting tool, such as a drill bit, releaseably secured within it. Within the spindle is generally mounted a piston which can be reciprocatingly driven by a hammer drive mechanism which translates the rotary drive of the motor to a reciprocating drive of the piston. A ram, also slideably mounted within the spindle, forward of the piston, is reciprocatingly driven by the piston due to successive over and under pressures in an air cushion formed within the spindle between the piston and the ram. The ram repeatedly impacts a beat piece slideably located within the spindle forward of the ram, which in turn transfers the forward impacts from the ram to the cutting tool releasably secured, for limited reciprocation, within the tool holder at the front of the hammer drill. A mode change mechanism can selectively engage and disengage the rotary drive to the spindle and/or the reciprocating drive to the piston. The three modes of operation of such a hammer drill are; hammer only mode, where there is only the reciprocating drive to the piston; drill only mode, where there is only the rotary drive to the spindle, and; hammer and drill mode, where there is both the rotary drive to the spindle the reciprocating drive to the piston.

EP1157788 discloses such a hammer.

While such hammer drills often comprise three modes of operation, it is also fairly common for hammer drills to only have either one or two modes of operation. For example, there are many types of hammer drills which only have drill only mode and which are more commonly referred to as a drill. One type of such a hammer drill is pavement breaker.

A pavement breaker is a hammer drill having only a single mode of operation, namely that of hammer only mode (sometimes referred to as chisel mode). Pavement breakers tend to be relatively large hammer drills, the weight of which being capable of being used to assist in the operation of the pavement breaker. Though theoretically it is possible to fully support a pavement breaker in the hands of the operator, typically their weight prohibits this or at least limits the amount that this can be done. As such, when manually manoeuvred, pavement breakers are typically utilised in a downward projecting manner so that the tool held in the tool holder is in contact with the ground, the weight of the pavement breaker being transferred to the ground through the cutting tool.

EP1475190 discloses a pavement breaker.

During the operation of a pavement breaker, the ram within it repeatedly strikes, via a beat piece, a cutting tool, such as a chisel, held within a tool holder located at the lower end of the body of the pavement breaker.

FIGS. 1 to 6 show a typical prior art design of tool and tool holder for a pavement breaker.

Referring to FIG. 1, the design of a cutting tool, such as a chisel, which can be used with these types of pavement breaker will now be described.

The tool comprises a working end (not shown) which engages with a work piece, such as a concrete floor, formed onto one end of a shank 400. The shank 400 has a hexagonal cross section in shape and a longitudinal axis 408. The other connection end 402, opposite to the working end, comprises a connection mechanism.

The first type of connection mechanism is in the form of rib 404 formed around the circumference of the shank 400 and which is located at a predetermine distance from the remote end of the connection end 402 of the shank. The second type of connection mechanism is in the form of recess 406 formed on one side of the shank 400 along part of the length of the shank 400 at a predetermined distance from the remote end of the connection end 402 of the shank. The third type, which is shown in FIG. 1, comprises both the rib 404 and the recess 406.

A tool with the first type of connection mechanism is intended to be used with a first type of tool holder which can engage with and hold the rib 404. A tool with the second type of connection mechanism is intended to be used with a second type of tool holder which can engage with the recess 406 to hold the tool. A tool with the third type of connection mechanism is intended to be used with either the first type of tool holder capable of holding a tool with the first type of connection mechanism, the second type of tool holder capable of holding a tool with a second type of connection mechanism, or a tool holder capable of holding a tool with the third type of connection mechanism.

However, there are designs of tool holder which are capable of holding tools with any of the three types of connection mechanism. Such a tool holder will now be described.

Referring to FIG. 1, the tool holder 500 comprises a tool holder housing 502 which is formed from a single metal cast which is attached to a middle housing 504 using a series of standard bolts 506. A plurality of holes 508 are formed through a flange 510 formed around the upper end of the tool holder housing 502. Corresponding holes 512 are formed through the base 514 of the middle housing 504. The bolts 506 pass through the holes 508 in the flange 510 of the tool holder housing 502 and then through the holes 512 through the base 514 of the middle housing 504. Standard nuts 518 are screwed onto the ends of the bolts 506 adjacent the base 514 of middle housing 516 to secure the tool holder housing 502 to the middle housing 504.

Integrally formed in the tool holder housing 502 is a tubular recess 520 of hexagonal cross section which is intended to receive the connection end 402 of the shank 400. The hexagonal cross section of the recess 520 and corresponding hexagonal cross section of the shank 400, and their respective sizes, prevent rotation of the tool within the recess 520.

A tubular passageway 522 is formed across the width of the tool holder housing 502. The cross sectional shape of the tubular passageway 522 is oval. The tubular passageway 522 intersects the top part of the tubular recess 520 at its centre. A metal rod 524, of circular cross section, passes through the full length of the tubular passageway 522, the ends 526 extending outwardly on either side of the tool holder housing 502. The centre 560 of the metal rod 524 comprises a circular groove 528 formed widthways, the maximum depth of which at its centre being half that of the width of the metal rod 524. The centre of the metal rod 524, which includes the groove 528, is located in and traverses across the top part of the tubular recess 520.

The metal rod 524 can freely rotate about its longitudinal axis 530 within the tubular passageway 522, the longitudinal axis 530 of the metal bar 524 being parallel with that of the tubular passageway 522. The oval shape of the passageway enables the bar 524 to slide in a direction (indicated by Arrow M) parallel to that of the longitudinal axis 408 of the tool when the tool is located within the tool holder 500.

Rigidly mounted onto the two ends 526 of the metal rod 524 is a U shaped clamp 532. The U shaped clamp 532 comprises two ends 534 which are in the form of rings. The two bar holes 536 of the rings 534 are co-axial and face each other. Attached to each end ring 534 is a curved arm 538. The ends of both the curved arms 538 connect to a semi-circular hook 540 as best seen in FIG. 100. The inner diameter of the hook 540 is greater than that of the shank 400 but less than that of the rib 404 of the tool. The end rings 534, the curved arms 538 and the hook 540 are manufactured from steel in a one piece construction.

Holes 542 are formed through the ends 526 of the metal bar 524, the axes of the holes 542 being parallel to each other and perpendicular to the longitudinal axis 530 of the metal bar 524. Holes 544 are formed through the end rings 534 of the U shaped clamp 532, the axes of the holes 544 being parallel to each other and perpendicular to the axis of the bar holes 536 of the end rings 534. The ends of the metal bar 524 locate within the bar holes 536 of the end rings 534 and orientated so that holes 542 of the metal bar 524 and the holes 544 of the end rings 534 are aligned (see FIG. 4). A pin (not shown) passes through each set of aligned holes 542, 544 to rigidly attach the end rings 534 to the ends 526 of the metal bar 524.

The metal rod 524 is held within tubular passageway 522 by two compressible rubber rings 546 which locate within cavities 548 formed in the side of the tool holder housing 502 (see FIG. 1). The rubber rings 546 bias the metal rod 524 to a central location within the tubular passageway 522. However, by compressing the rubber rings 546, the metal rod 524 can be moved within the oval tubular passageway 522 in a direction (Arrow M) parallel to the longitudinal axis 408 of the tool.

The U shaped clamp 532 pivots, in unison with the metal rod 524, about the longitudinal axis 530 of the metal rod 524. Pivotal movement of the U shaped clamp 532 locks the tool 400 within the tool holder or releases it.

The U shaped clamp 532 itself is used to hold a tool with the first type of connection mechanism by engaging with the rib 404 of the tool. The U shaped clamp 532 is pivoted to a position where the tubular recess 520 is exposed. (It should be noted that U shaped clamp 532 will be in a position where the circular groove 528 of the metal bar 524 faces towards the tubular recess 520 so that the metal bar 524 does not interfere with the insertion of the connection end 402 of the tool). The connection end 402 of the tool is inserted into the tubular recess 520 until the rib 404 engages with the nose 550 of the tool holder housing 502. The U shaped clamp 532 is then pivoted until the hook 540 of the U shaped clamp 532 surrounds the shank 400 of the tool below the rib 404. In this position, the rib 404 is prevented from travelling past the hook 540 of the U shaped clamp 532. As the connection end 402 of the tool slides out of the tubular recess 520, the rib 404 engages with the hook 540 of the U shaped clamp 532 and is then prevented from travelling further. As such, the connection end 402 of tool is held within the tubular recess 520 whilst being able to slide axially over a limited range of travel, the range of movement being the distance the rib 404 can slide between the nose 550 and the hook 540 (as best seen in FIG. 3). To release the tool, the U shaped clamp is pivoted so that the hook is removed from the path way of the rib 404, to allow the connection end 402 to fully slide out of the tubular recess 520.

A first locking mechanism is provided for U shaped clamp 532 so that, when the hook surrounds the shank 400 to lock the tool within the tool holder, the U shaped clam 532, including the hook 540, is locked in that position to prevent the tool inadvertently being released from the tool holder. Formed on the periphery of the two rings 534 of the U shaped clamp 532 are first flat locking surfaces 552. Formed on the tool holder housing 502 are corresponding flat holding surfaces 554. When the hook 540 surrounds the shank 400 to hold the tool in the tool holder, the flat locking faces 552 and the flat holding surfaces 554 are aligned with each other and are biased together by the rubber rings 546 (which biases the metal bar 524 in the direction of Arrow M to a central position within the tubular passageway 522) so that they abut against each other (see FIG. 5—solid lines). As the surfaces 552, 554 are flat and are biased together, the rings 534 are prevented from rotating. In order to rotate the rings 534, and hence pivot the U shaped clamp, the U shaped clam 532 has to move axially (direction of Arrow M) to allow the flat locking faces 552 to pivot relative to the flat holding surfaces 554 (see dashed lines in FIG. 5). The axial movement (Arrow M) of the U shaped clamp 532 is achieved by the compression of the rubber rings 546 within the cavities 548 which allow the metal bar 524 to slide within the oval tubular passageway 522. Pivotal movement of the U shaped clamp 532 causes the rubber rings 546 to compress, allowing the first flat locking surfaces 552 to ride over the flat holding surfaces 554. The biasing force of the rings 546 hold the locking surfaces 552 against the holding surfaces 554 and hence lock the U shaped clamp 532 in the locking position.

The metal rod 524 itself is used hold a tool with the second type of connection mechanism by engaging with the recess 406 of the tool. The metal rod 524 is pivoted to a position where the U shaped clamp 532 is located away from the location of the tool, leaving the recess 520 exposed. The precise position of the U shaped clamp 532 is such that the circular groove 528 of the metal bar 524 faces into the tubular recess 520. As such, there are no restrictions within the tubular recess 520 to prevent the connection end 402 of the tool 400 fully entering the tubular recess 520.

The connection end 402 of the tool is fully inserted into the tubular recess 520. It has to be ensured that the recess 406 of the tool 400 faces upwards towards the metal bar 524. (It should be noted that the tool can not be rotated within the recess 520 due to the cross sectional shapes of the shank 402 and the recess 520.)

When the connection end 402 of the tool 400 is fully inserted into the tubular recess 520, that the groove 528 of the metal bar 524 faces into recess 406 of the tool.

The U shaped clamp 532 is then pivoted, causing the metal bar 524 to pivot, until the groove 528 of the metal bar 524 faces away from the recess 406 of the tool. At this point, the central part 560 of the metal bar 524 faces towards and locates within the tubular recess 520 of the tool holder and thus faces towards and locates within the recess 406 of the tool 400. This is best seen in FIG. 2.

In this position, the upper 412 and lower 414 edges of recess 406 are prevented from travelling past the central part 560 of the metal bar 524. As the connection end 402 of the tool slides out of the tubular recess 520, the upper edge 412 engages with the central part 560 of the metal bar 524 and is then prevented from travelling further. As such, the connection end 402 of tool is held within the tubular recess 520 whilst being able to slide axially of a limited range of travel, the range of movement being the distance the central part 560 can slide between the upper 412 and lower 414 edges of the recess 406 (as best seen in FIG. 2).

To release the tool, the U shaped clamp 532 is pivoted in order to pivot the metal bar 524 in order to remove the central part 560 of the metal bar 524 from the recess 406 of the tool 400, which allows the connection end 402 of the tool to fully slide out of the tubular recess 520.

A second locking mechanism is provided for U shaped clamp 532 so that, when the central part 560 of the metal bar 524 is located within the recess 406 of the tool 400 to lock the tool 400 within the tool holder, the U shaped clam 532, including the metal bar 524, is locked in that position to prevent the tool inadvertently being released from the tool holder. Formed on the periphery of the two rings 534 of the U shaped clamp 532 are second flat locking surfaces 562. As described previously, formed on the tool holder housing 502 are flat holding surfaces 554. When the central part 560 of the metal bar 524 is located within the recess 406 of the tool 400 to hold the tool in the tool holder, the second flat locking faces 562 and the flat holding surfaces 554 are aligned with each other and are biased towards each other by the rubber rings 546 so that they abut against each other (see FIG. 6—solid lines). As the surfaces are flat, the rings 534 are prevented from rotating. In order to rotate the ring and hence pivot the U shaped clamp 532 and the metal bar 524, the U shaped clam 532 has to move axially (direction of Arrow M) to allow the second flat locking faces 562 to pivot relative to the flat holding surfaces 554 (see dashed lines in FIG. 6). The axial movement of the U shaped clamp 532 is achieved by the compression of the rubber rings 546 within the cavities 548 which allow the metal bar 524 to slide within the oval tubular passageway 522. Pivotal movement of the U shaped clamp 532 causes the rubber rings 546 to compress, allowing the second flat locking surfaces 562 to ride over the flat holding surfaces 554. The biasing force of the rings 546 hold the second locking surfaces 562 against the holding surfaces 554 and hence lock the U shaped clamp 532, and hence the metal bar 524, in the locking position.

Such a tool holder can hold all tools with any of the three types of connection mechanisms.

During the operation of a pavement breaker having such tool holder, the beat piece 564 repeated strikes the connection end 402 of the tool 400. The diameter of the head 566 of the beat piece 564 is greater than that of the tubular recess 520 required to receive the connection end 402 of the tool 400. As such, the top end 568 of the tubular recess 520 has an increased diameter to enable the head 566 of the beat piece 564 to travel along the length of the top end 568 of the tubular recess 520.

Forward, downward movement of the beat piece 564 along an axis 570 (parallel to the longitudinal axis of the tool 400 when held within the tool holder) is limited by a front shoulder 572 of the head 566 of the beat piece 564 engaging with a lower stop 574 formed between the top end 568 section of the tubular recess 520 and the remainder of the tubular recess 520.

Rearward, upward movement of the beat piece 564 along the axis 570 is limited by a rear shoulder 576 of the head 566 of the beat piece 564 engaging with an upper stop 578 formed on a side of a metal ring 580 rigidly attached to the top end of the tool holder housing 502.

The tool holder and beat piece 564 support structure, which includes the top end section 568 of the tubular recess 520 and the metal ring 580, are designed so that when it used to hold a tool having the first type of connection mechanism, the rib 404 is always able to engage with the nose 550 of the tool holder housing 502. When the connection end 402 of the tool 400 is inserted into the tubular recess 520, it engages with the head 566 of the beat piece 564, which is biased downwardly due to gravity, and pushes it upwardly. As the connection end 402 slides into the tubular recess 520, it pushes the beat piece upwardly against the biasing force of gravity. The design of the tool holder and beat piece 564 support structure is arranged so that the rib 404 always engages with the nose 550 of the tool holder housing 502 prior to the rear shoulder 576 of the head 566 of the beat piece 564 engaging with the upper stop 578 formed on a side of the metal ring 580 rigidly attached to the top end of the tool holder housing 502.

Pavement breakers generate a great deal of vibration during its operation. In order to make a pavement breaker as user friendly as possible, it is desirable to minimise the amount of vibration experienced by the operator as small as possible. One method of achieving this is to use a dampening mechanism to counteract the vibration generated by the operation of the pavement breaker. EP1252976 discloses a hammer drill having such a dampening mechanism.

EP1252976 shows a hammer drill having a cylinder, a piston reciprocatingly driven within the cylinder by a motor, a ram slideably mounted within the cylinder which is reciprocatingly driven by the piston via an air spring, and a beat piece which is repetitively struck by the ram and which, in turn, strikes an end of a cutting tool, such as a chisel, held within a tool holder. An oscillating counter mass is used to reduce vibration within the hammer drill. The counter mass surrounds and is slideably mounted on the cylinder and is held between two springs which bias the counter mass to a predetermined position on the cylinder. The mass of the counter mass and the strength of the springs are such that, when the hammer drill is operated, the counter mass vibrates out of phase with the piston and ram so that it counteracts the vibration generated by the operation of the hammer drill.

Pavement breakers, as with any power tool, require internal lubrication of its component parts, to ensure the efficient functioning of the tool. It is important to ensure that that all internal component parts of sufficiently lubricated, particularly the drive gears and crank. In order to achieve this, it is important to provide efficient method by which the lubricant can be distributed within the pavement breaker, particularly in the housing where the gears and crank are located.

SUMMARY

In an aspect, a powered hammer includes a housing, a tool holder coupled to the housing and configured to hold a tool, a motor within the housing, a cylinder disposed within the housing, and a piston slideably mounted within the cylinder. A drive mechanism converts rotary output of the motor into a reciprocating motion of the piston. The drive mechanism includes a crank shaft rotationally driven by the motor, a drive pin eccentrically mounted on the crank shaft, and a con rod with a first end connected to the drive pin and a second end connected to the piston. A ram is slideably mounted forward of the piston that is reciprocatingly driven by the piston. A beat piece is slideably mounted forward of the ram. The beat piece is repetitively struck by the reciprocating ram, which in turn repetitively strikes an end of the tool when held in the tool holder to transfer the momentum of the ram to the tool. Lubrication fluid covers at least part of the drive mechanism. A rear piston chamber is formed within an end of the cylinder, rearward of the piston, the volume of which repetitively changes as the piston moves within the cylinder, causing air within the housing to be at least one of drawn into and blown out of the rear piston chamber. The movement of air causes the lubrication fluid to move within the housing. A longitudinal passageway defined in at least one of the crank shaft and the drive pin enables passage of air and the lubricating fluid to assist in movement of the lubrication fluid within the housing.

Implementations of this aspect may include one or more of the following features. As air is drawn into the rear piston chamber, air and lubrication fluid move through the longitudinal passageway in one direction, and as air is blown out of the rear piston chamber, air and lubrication fluid move through the longitudinal passageway in an opposite direction. The con rod is connected to the drive pin via a bearing, and a crank shaft fluid guide is connected to an end of the longitudinal passageway to direct the lubricating fluid towards the bearing when the lubricating fluid exits the longitudinal passageway. The crank shaft fluid guide directs lubricating fluid toward a guide mechanism. The movement of the lubricating fluid from the crank shaft fluid guide to the guide mechanism is at least partially due to the movement of air within the housing. The movement of the lubricating fluid from the crank shaft guide to the guide mechanism is at least partially due to a centrifugal force acting on that lubrication fluid generated by the rotation of the crank shaft. The guide mechanism directs the lubricating fluid towards the bearing, the movement of that lubrication fluid being caused by the centrifugal force. The guide mechanism comprises a groove formed in a support structure. The groove extends away from a base of the drive pin toward an axis of rotation of the crank shaft. The crank shaft fluid guide includes a plastic cap that clips into an end of the longitudinal passageway.

In another aspect, a powered hammer includes a housing, a tool holder coupled to the housing and configured to hold a tool, a motor within the housing, a cylinder disposed within the housing, a piston slideably mounted within the cylinder, and a drive mechanism that converts rotary output of the motor into a reciprocating motion of the piston. The drive mechanism includes a crank shaft rotationally driven by the motor, a drive pin eccentrically mounted on the crank shaft via a support structure, and a con rod with a first end connected to the drive pin via a bearing and a second end connected to the piston. A ram is slideably mounted forward of the piston and is reciprocatingly driven by the piston. A beat piece is slideably mounted forward of the ram and is repetitively struck by the reciprocating ram, which in turn repetitively strikes an end of the tool when held in the tool holder to transfer the momentum of the ram to the tool. Lubrication fluid covers at least part of the drive mechanism. Movement of the lubrication fluid is at least in part caused by a centrifugal force generated by rotation of the crank shaft. A guide mechanism is configured to direct the movement at least a portion of the lubrication fluid toward the bearing.

Implementations of this aspect may include one or more of the following features. The guide mechanism includes a groove formed in the support structure. The groove extends away from a base of the drive pin toward an axis of rotation of the crank shaft. A rear piston chamber is formed within an end of the cylinder, rearward of the piston, the volume of which repetitively changes as the piston moves within the cylinder, causing air within the housing to be at least one of drawn into and blown out of the rear piston chamber, the movement of air causing the lubrication fluid to move within the housing. A passageway is defined in at least one of the crank shaft and the drive pin to enable passage of air and the lubricating fluid to assist in movement of the lubrication fluid within the housing. The movement of the lubricating fluid from the crank shaft fluid guide to the guide mechanism is at least partially due to the movement of air within the housing.

These and other features and advantages will be apparent from the description, the drawings, and the claims.

BRIEF DESCRIPTION OF THE DRAWINGS

An embodiment of the invention will now be described with reference to the accompanying drawings of which:

FIG. 13A showing a top view;

FIG. 13B showing a vertical cross section;

FIG. 13C showing a side view;

FIG. 13D showing a bottom view;

FIG. 13E showing a side view, 90 degrees to that of FIG. 13C

FIG. 13F showing a perspective view;

FIG. 13G showing a perspective view, 90 degrees to that of FIG. 13F;

DETAILED DESCRIPTION OF THE DRAWINGS

Figure 1:
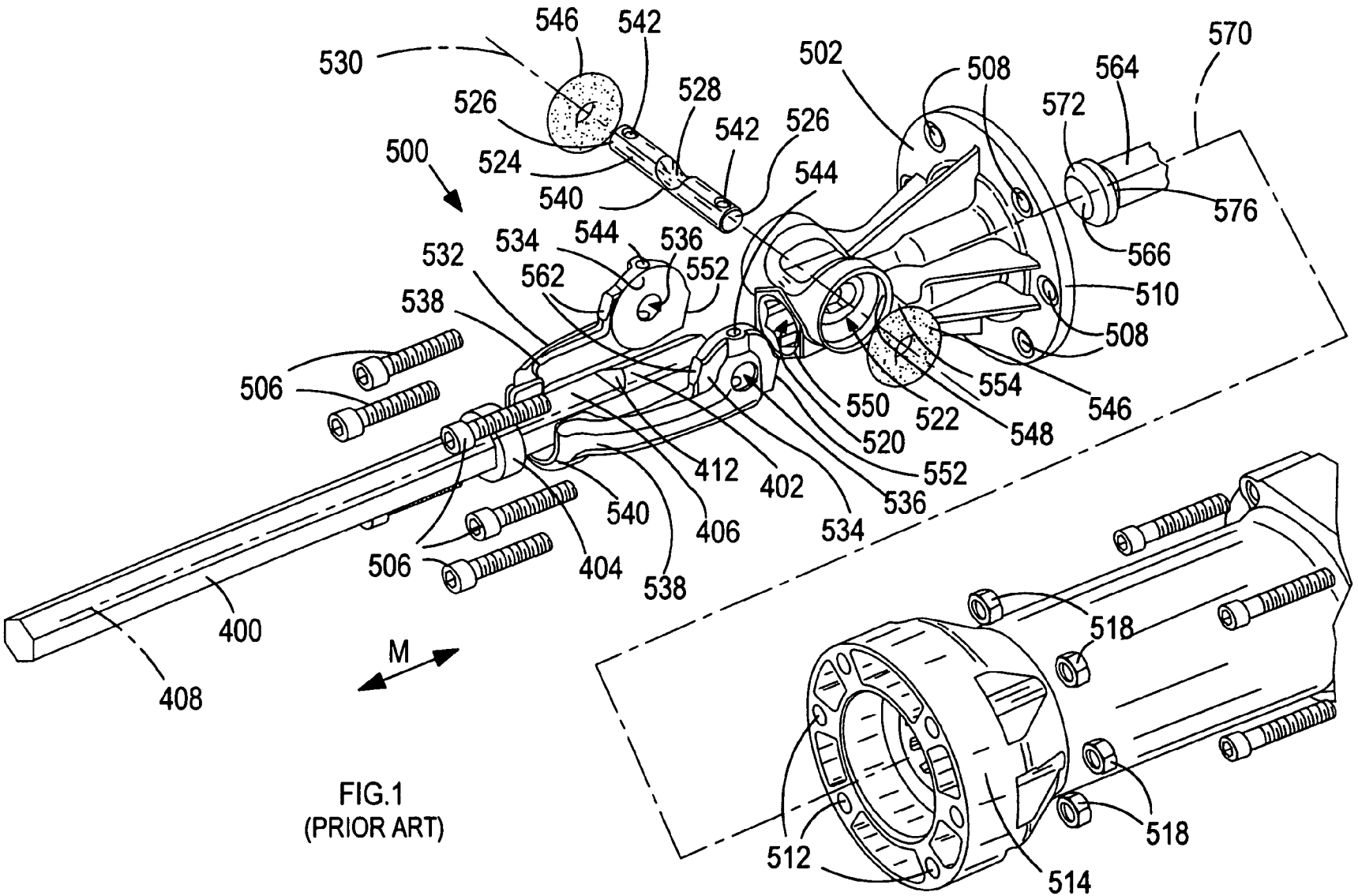
FIG.1 (PRIOR ART)
FIG. 1 shows an exploded view of a prior art design of tool holder.
Figure 2:
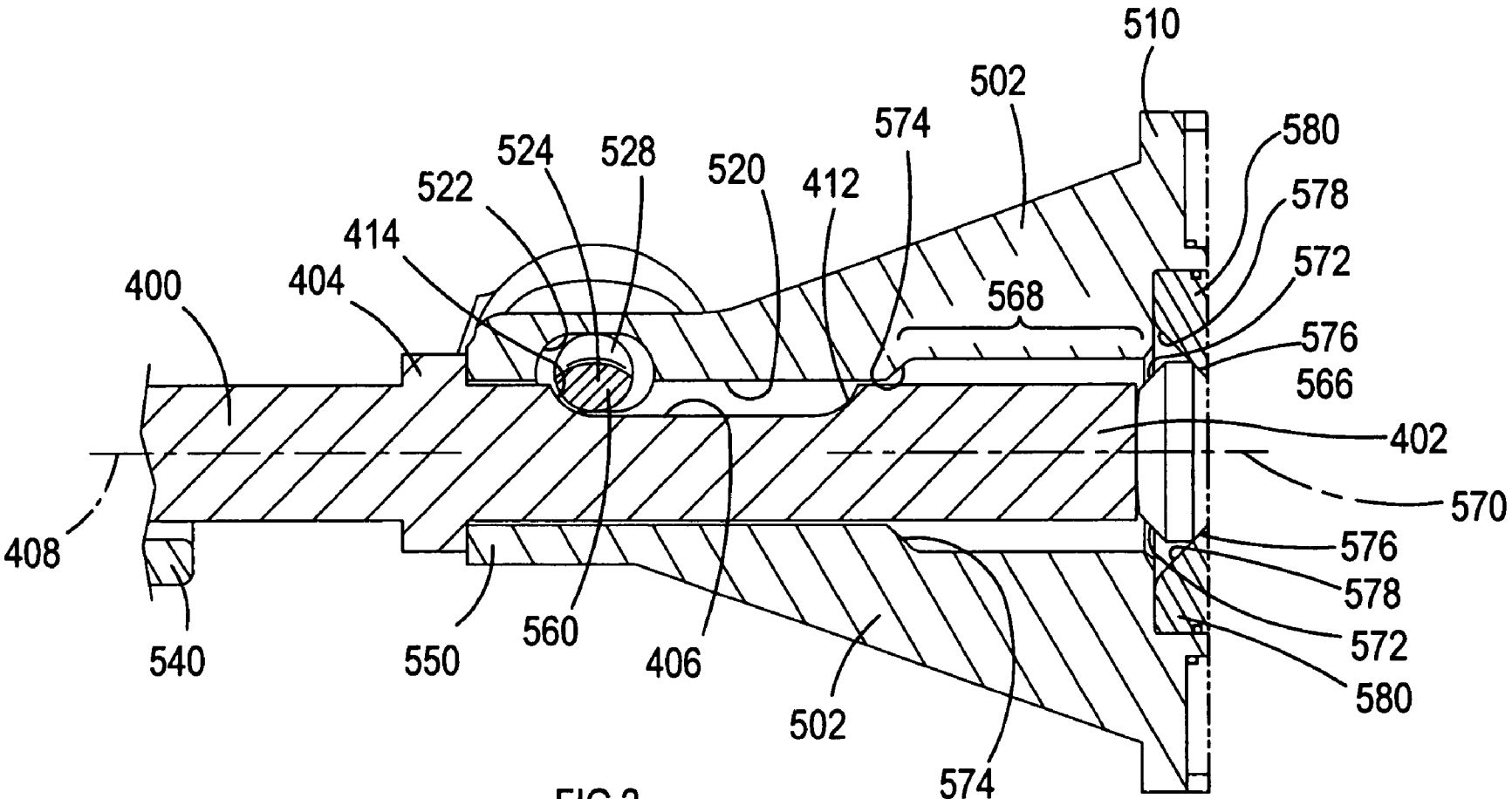
FIG.2 (PRIOR ART)
FIG. 2 shows a vertical cross section of the tool holder of FIG. 1, with the end of the tool located within the tool holder.
Figure 3:
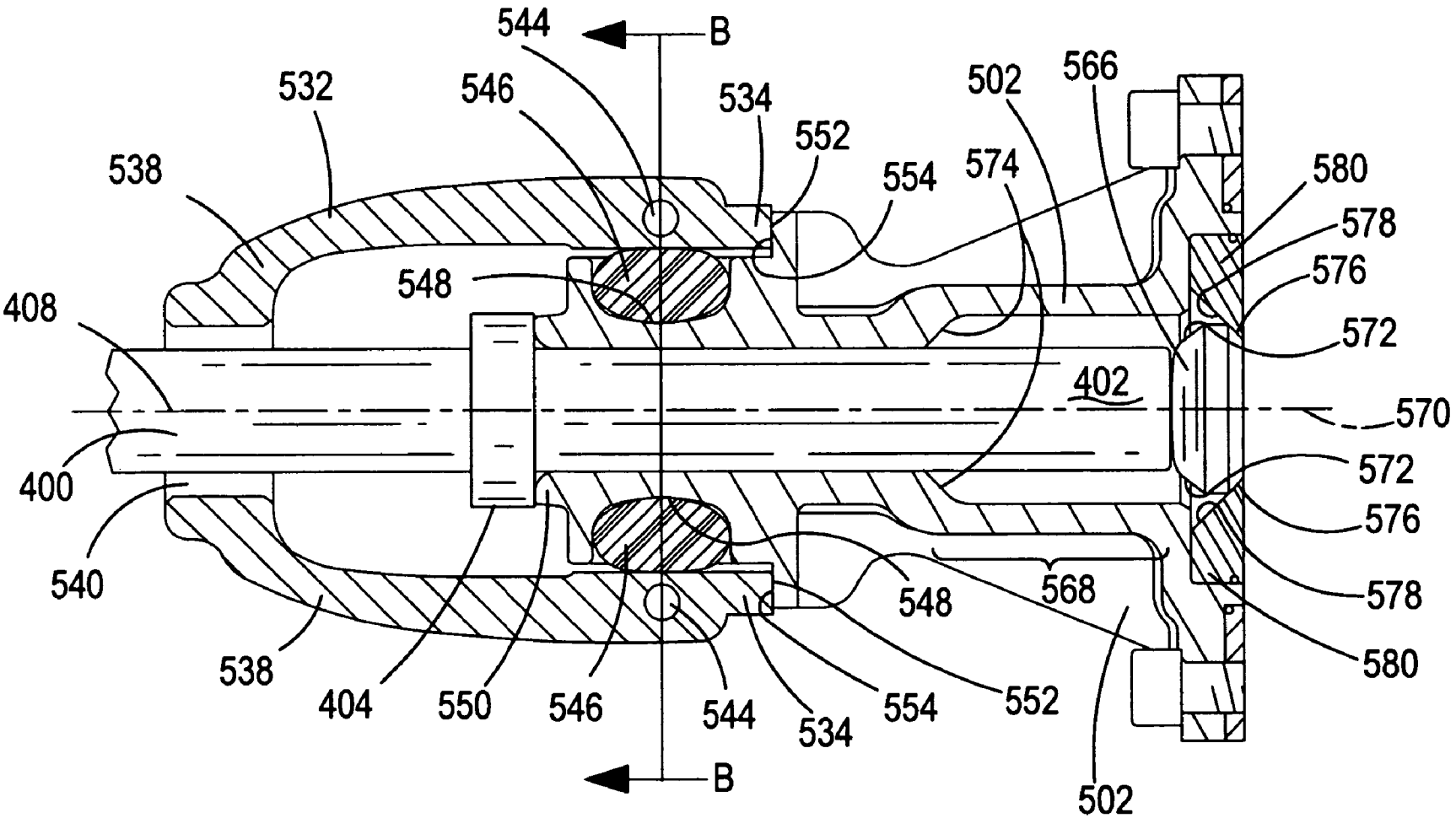
FIG.3 (PRIOR ART)
FIG. 3 shows a vertical cross section of the tool holder of FIG. 1 orientated through 90 degrees to that of FIG. 2, with the end of the tool located within the tool holder.
Figure 4:
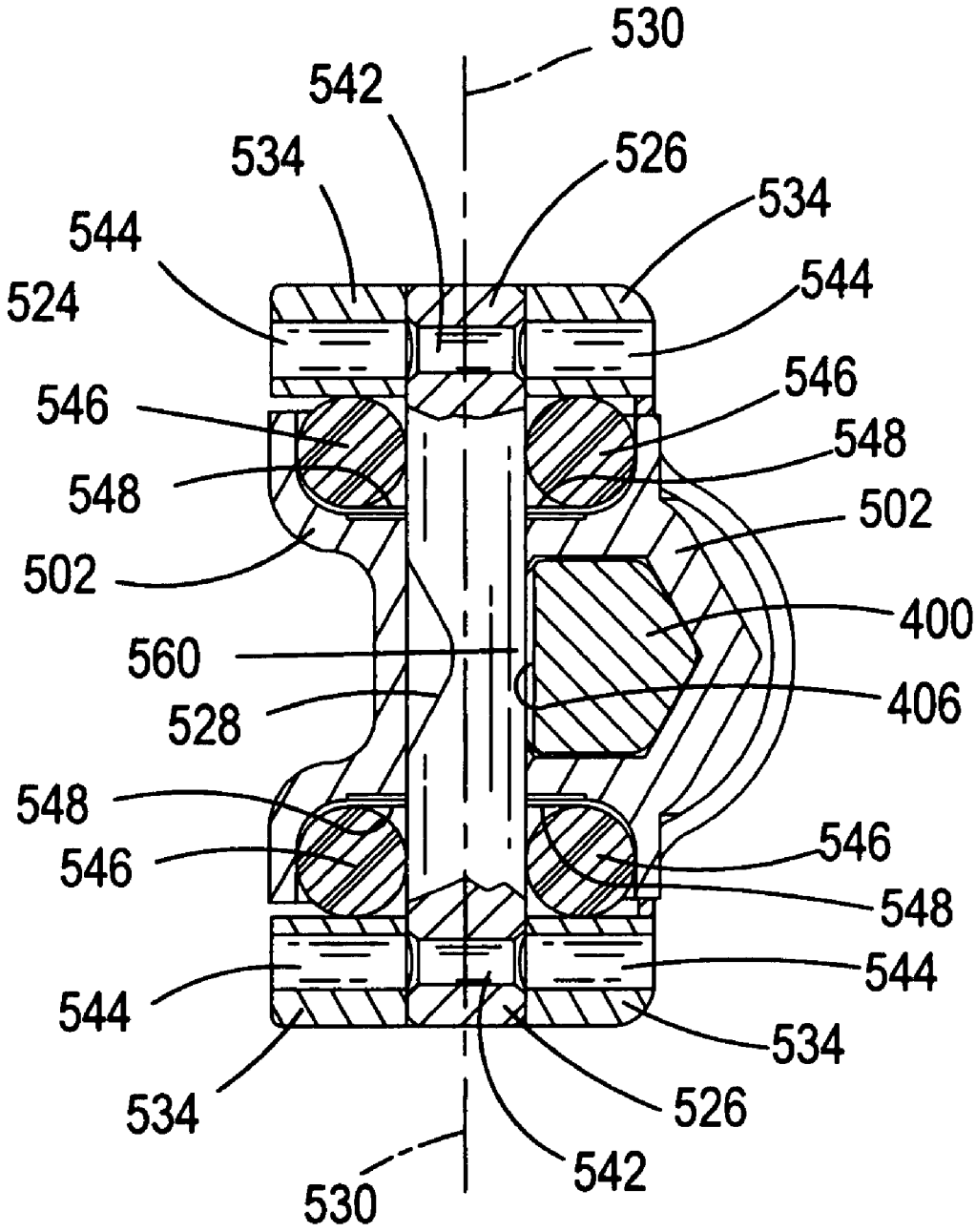
FIG.4 (PRIOR ART)
FIG. 4 shows a cross section of the tool holder holding the tool in the direction of Arrows B in FIG. 3.
Figure 5:
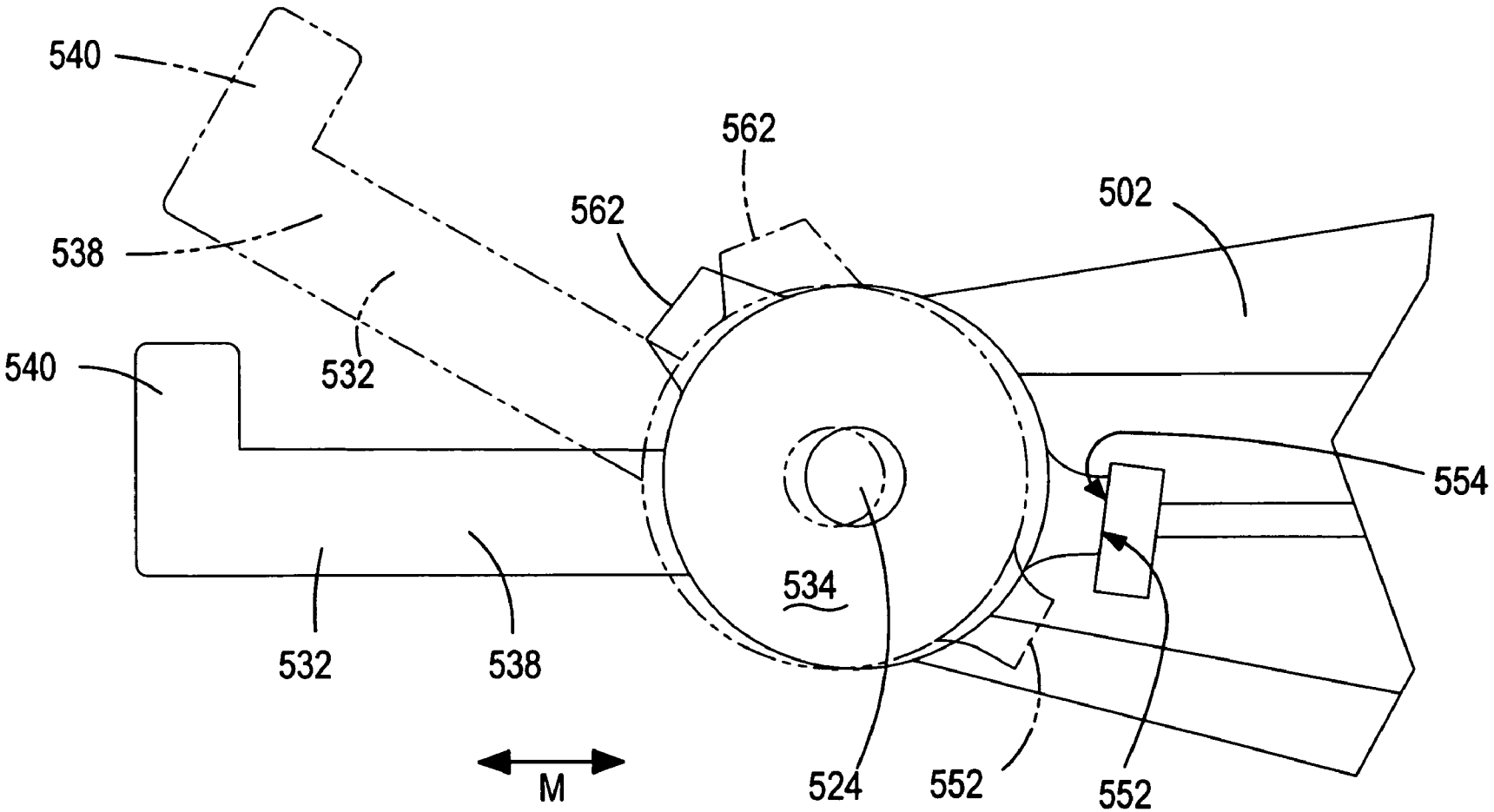
FIG.5 (PRIOR ART)
FIG. 5 shows a side view of the prior art design of tool holder with the U shaped clamp in a first locking position.
Figure 6:
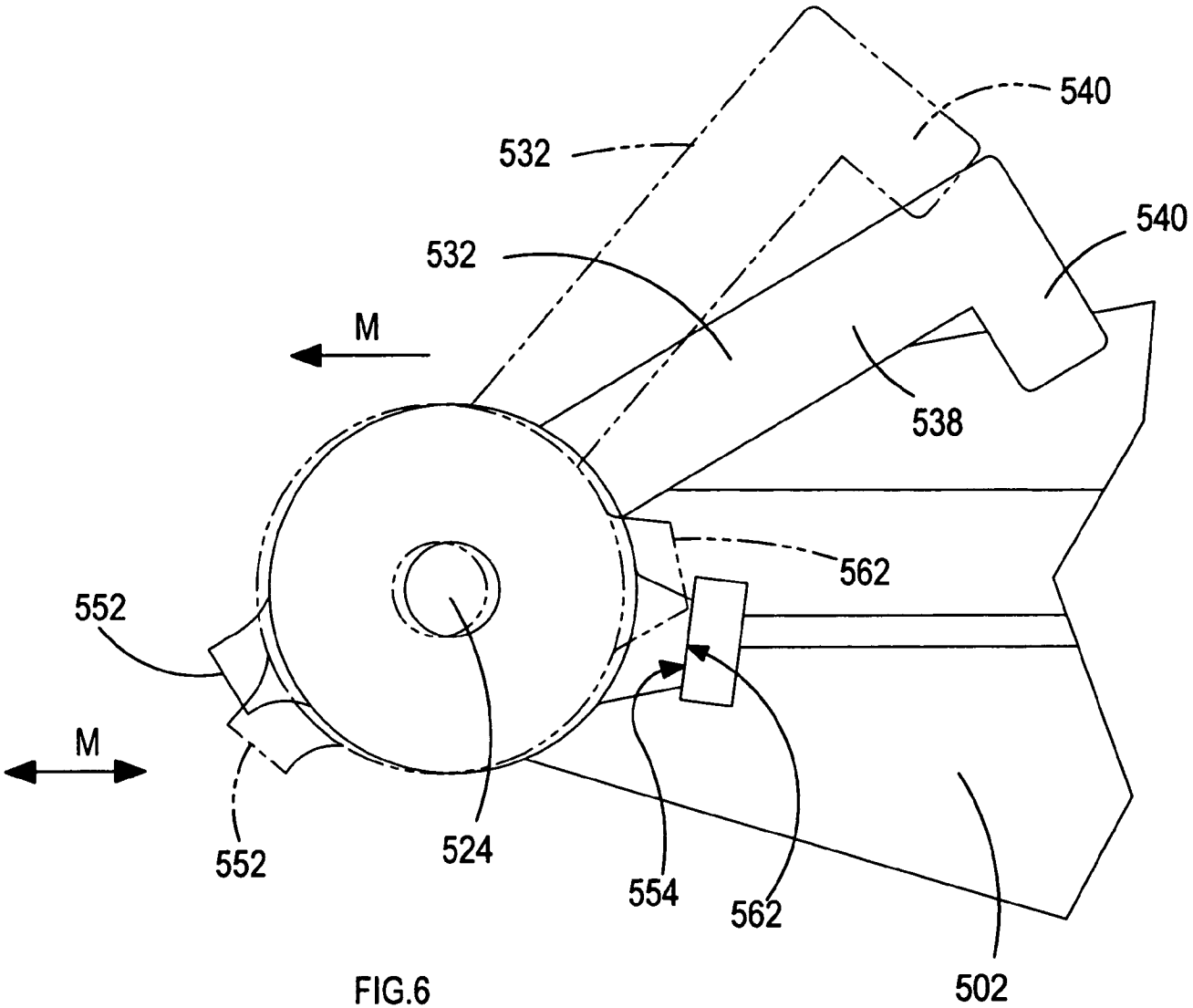
FIG.6 (PRIOR ART)
FIG. 6 shows a side view of the prior art design of tool holder with the U shaped clamp in a second locking position.
Figure 7:
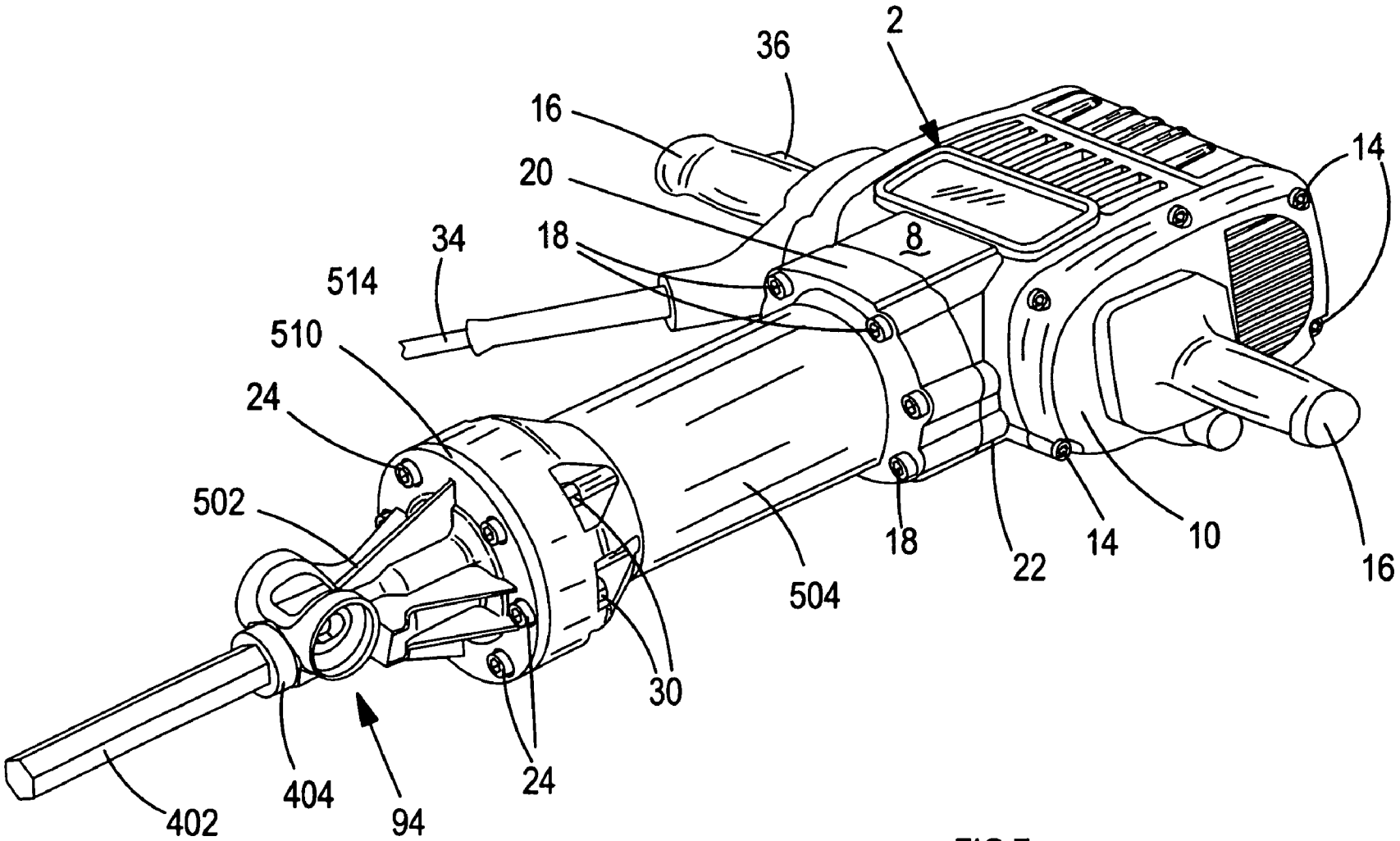
FIG. 7 shows a perspective view of a pavement breaker (excluding the U shaped clamp) according to the present invention.
Figure 8A:
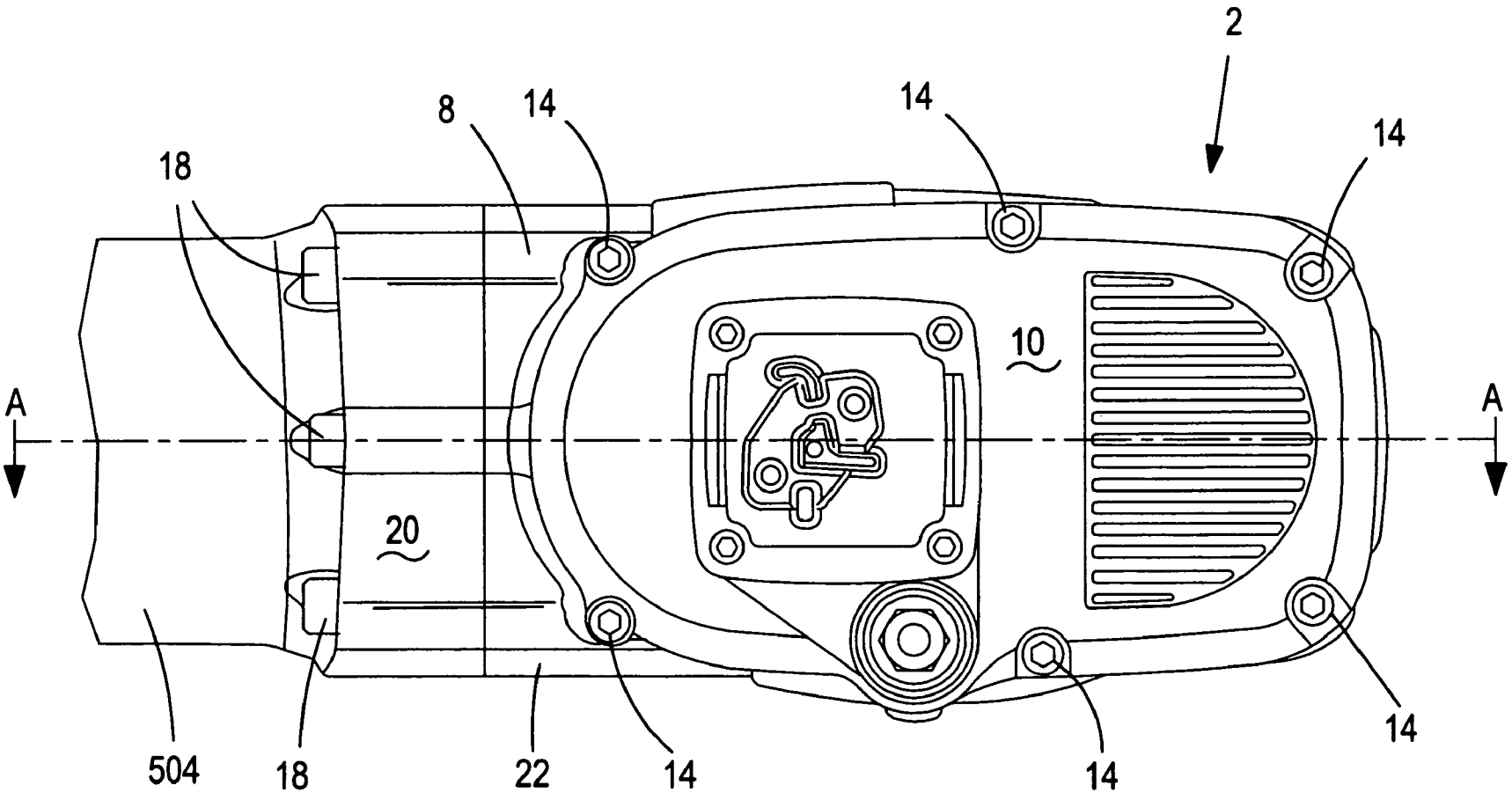
FIG. 8A shows a side view of the upper end of the pavement breaker (excluding a handle) according to the present invention.
Figure 8B:
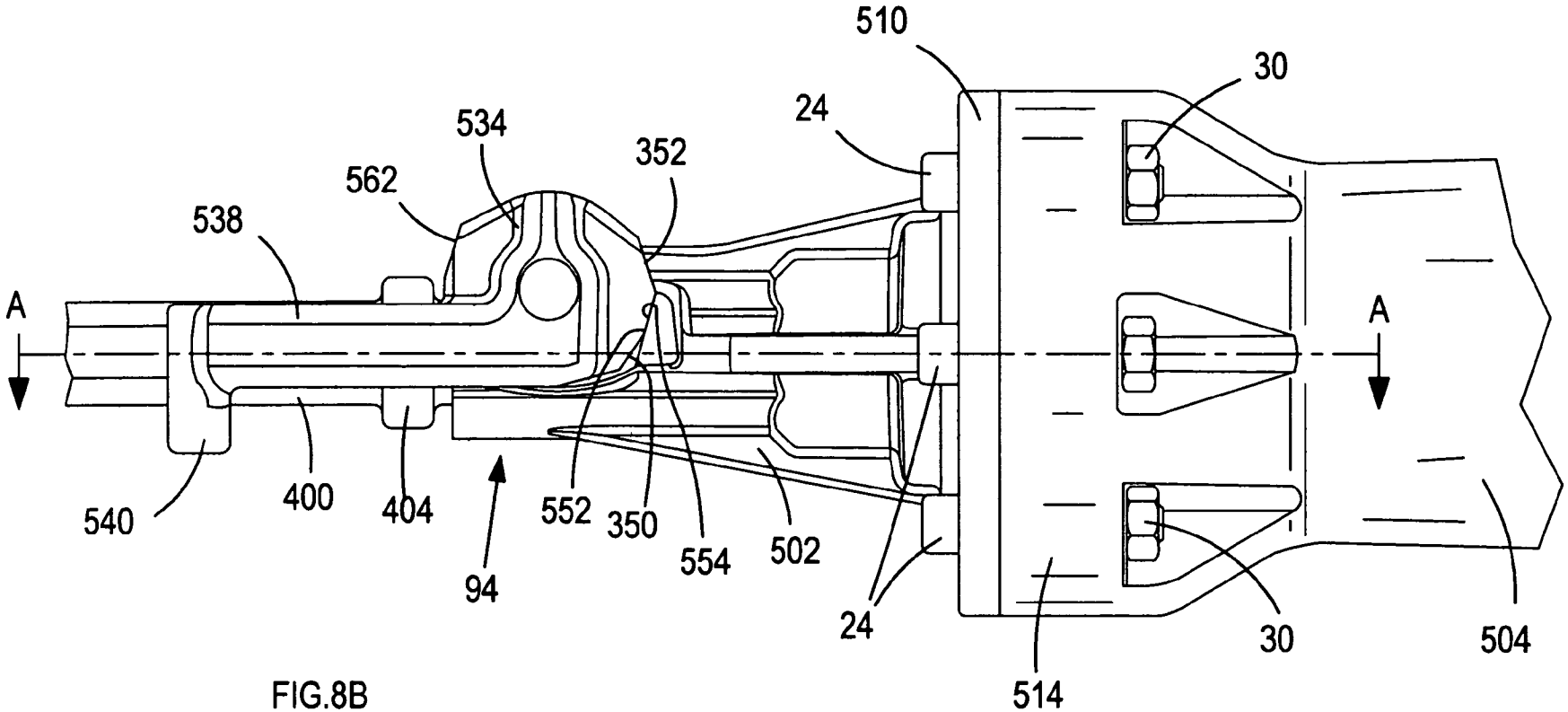
FIG. 8B shows a side view of the lower end of the pavement breaker according to the present invention, FIGS. 8A and 8B showing a side of the pavement breaker according to the present invention (excluding a handle) when combined.

Referring to FIG. 1, the pavement breaker consists of an upper housing 2, a middle housing 504, and a tool holder housing 502. (Where the same features are present in the present embodiment of the pavement breaker which are also present in the tool holder described above with reference to FIGS. 1 to 6, the same reference numbers have been used. However, where there are new features are present which are similar, but not the same as previous features, new reference numbers have been allocated. New features will also have new reference numbers.)

The upper housing 2 consists of a central clamshell 8, and two side clamshells 10, one attached to each side of the central clamshell 8 by a plurality of screws 14. Attached to each side clamshell 10 is a handle 16 by which an operator supports the pavement breaker during use.

The middle housing 504 comprises a single metal cast which is attached to the upper housing 2 using a series of bolts 18 which pass through apertures formed through a flange 20 located at the upper end of the middle housing 504 and threadably engage in threaded holes formed in the lower end 22 of the central clamshell 8 of the upper housing 2.

The tool holder housing 502 comprises a single metal cast which is attached to the middle housing 504 using a series of bolts 24. A plurality of holes 508 are formed through a flange 510 formed around the upper end of the tool holder housing 502. Corresponding holes 512 are formed through the base 514 of the middle housing 504. The bolts 24 pass through the holes 508 in the flange 510 of the tool holder housing 502 and then through the holes 512 through the base 514 of the middle housing 504. self locking Heli-coil nuts 30 are screwed onto the ends of the bolts 24 adjacent the base 514 of middle housing 504 to secure the tool holder housing 502 to the middle housing 504. A rubber seal 82 is provided between the tool holder housing 502 and the middle housing 504.

Figure 11A:
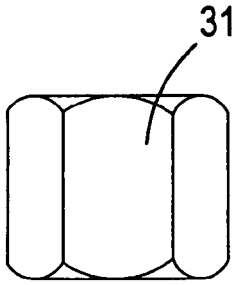
FIG. 11A shows a side view of a Heli-Coil® nut.
Figure 11B:
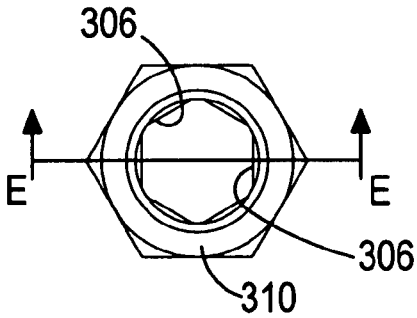
FIG. 11B shows a top view of a Heli-Coil® nut.
Figure 11C:
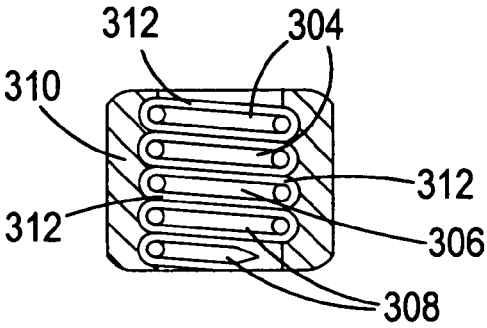
FIG. 11C shows a vertical cross section of a Heli-Coil® nut as view in the direction of Arrows B in FIG. 11B.
Figure 11D:
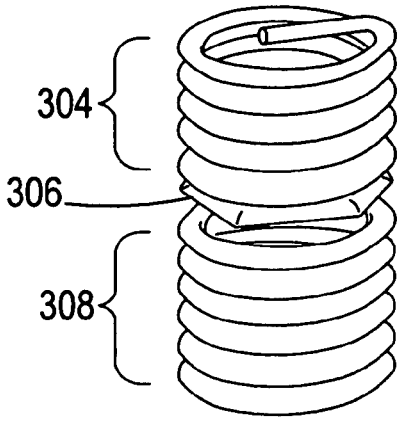
FIG. 11D shows a side view of a Heli-Coil® on its own.

A self locking Heli-coil nuts 30 will now be described with reference to FIGS. 11A to 11D. A Heli-coil© is shown in FIG. 11D. It comprises a coil of wire. The coil of wire comprises an upper section 304, a middle coil 306 and a lower section 308. The upper 304 and lower 308 sections comprise coils which follow a circular path. The middle coil comprises a series of straight segments to form a hexagonal path. A Heli-coil© nut comprises a standard design of nut 310 having a threaded passageway passing through it in conventional manner. A Heli-coil©, having a coil of wire with the same pitch of thread as the thread of the nut and which is made from wire which has a diameter corresponding to the dimensions of the grooves of the thread of the nut, is located within the thread 312 of the nut 310. The Heli-coil® now acts as the thread for the nut 310. The middle coil 306 provides the Hel-coil® nut with self locking feature so that when it is screwed onto a bolt it grips onto the bolt and prevents the Heli-coil® nut from unscrewing. The reason why the middle coil provides the self locking feature is that it has a hexagonal shape where as the cross sectional shape of the shaft of a bolt is round. As such, the middle coil exerts a gripping force onto the shaft of a bolt when is screwed onto the shaft.

The Heli-coil© spreads out the stress placed onto the thread of the nut across all of the thread within the nut rather than exerting stress onto one part of the thread.

Figure 9A:
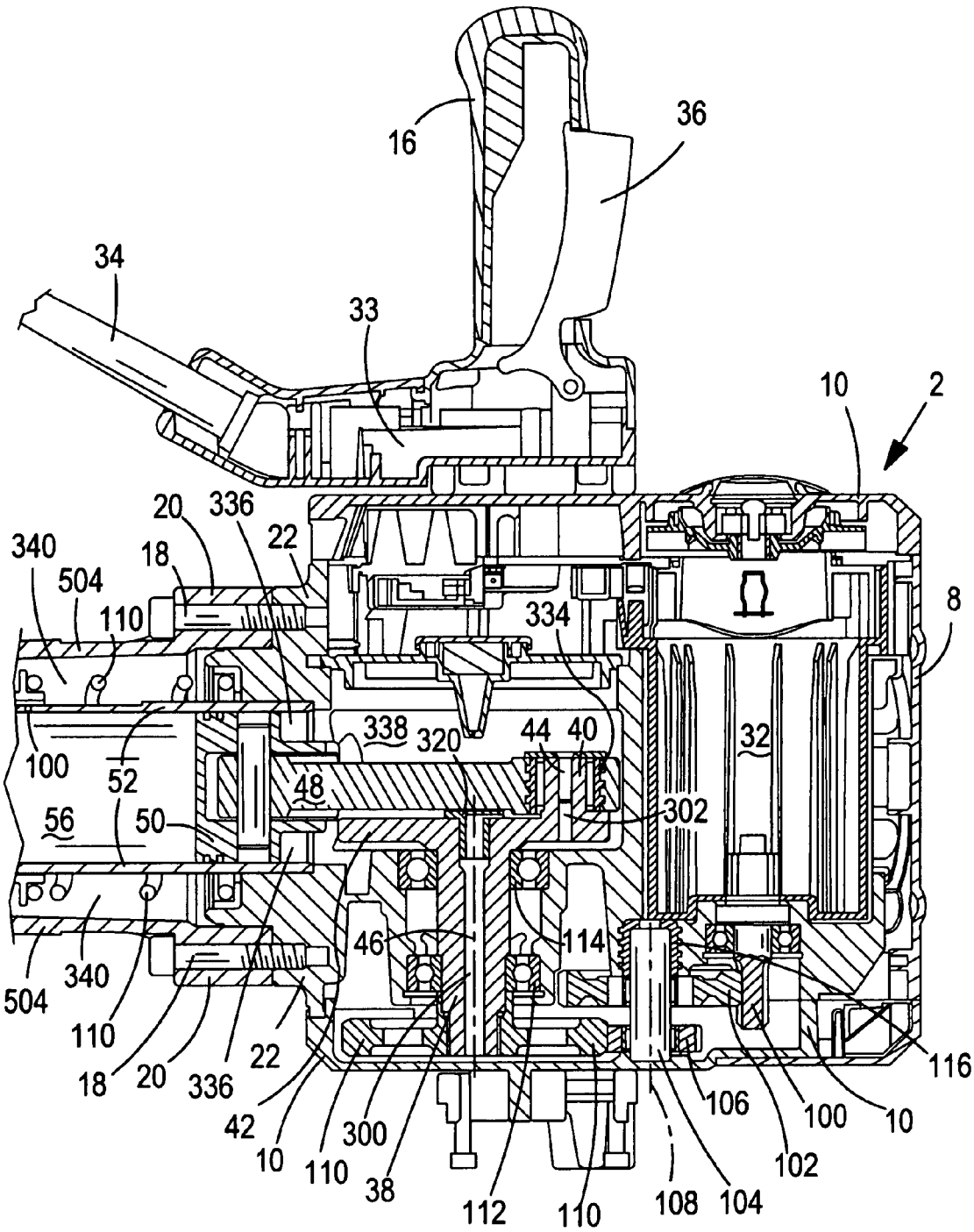
FIG. 9A shows a vertical cross section of the upper end of the pavement breaker (excluding a handle) in the direction of Arrows A in FIGS. 8A and 8B.

Referring to FIG. 9A, located in the upper housing is an electric motor 32 which is powered by an electricity supply provided from an electric cable 34 which connects to the motor 32 with the via an electric switch 33. A pivotal lever 36, connected to the switch, is located on a handle 16. Depression of the lever 36 activates the electric motor 32.

The electric motor 32 rotating drives a crankshaft 38 via a plurality of gears. The splined output shaft 100 of the motor 32 rotatingly drives a first gear 102 which is rigidly mounted on a rotatable shaft 104. The routable shaft 104 is rotationally mounted within the upper housing 2 via a bearing 116. A second gear 106 is also rigidly mounted on the rotatable shaft 104, adjacent the first gear 102, such that rotation of the first gear about the longitudinal axis 108 of the rotatable shaft 104 results in rotation of the second gear 106 about the longitudinal axis 108 at the same rate as the first gear 102. The second gear 106 meshes with a third gear 110 which is rigidly mounted onto the end of the crank shaft 38. The crank shaft 38 is rotatably mounted in the upper housing 2 via two sets of bearings 112, 114.

Figure 12:
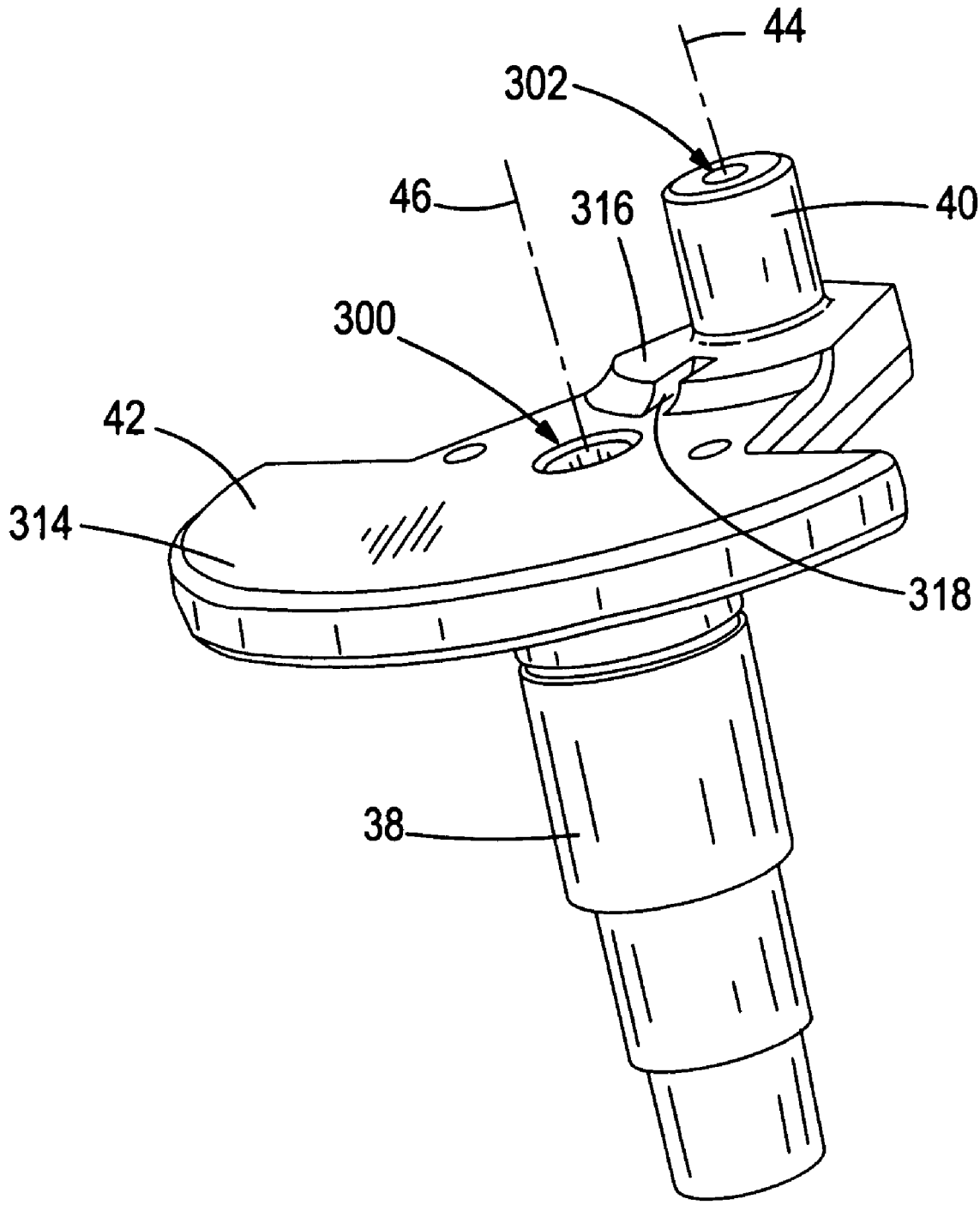
FIG. 12 shows a perspective view of the crank shaft, disk and drive pin 40.
Figure 13A:
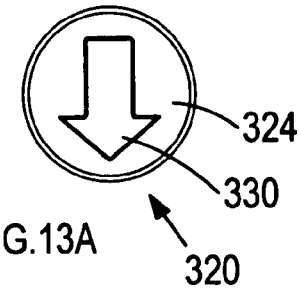
FIG. 13A to 13G show an oil cap for the crank shaft.
Figure 13B:
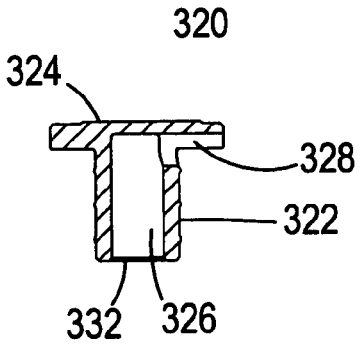
Figure 13C:
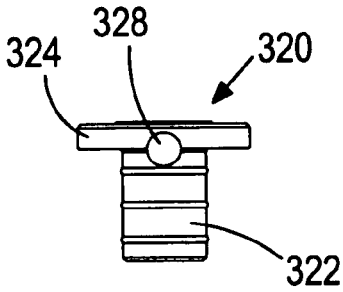
Figure 13E:
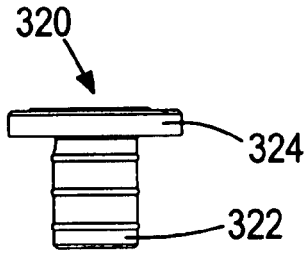
Figure 13D:
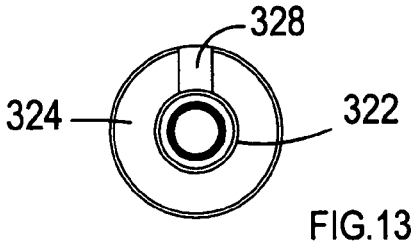
Figure 13F:
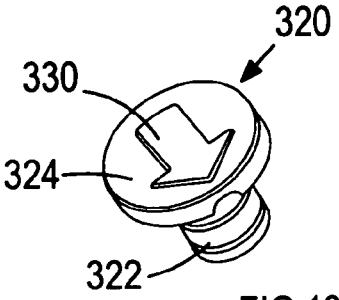
Figure 13G:
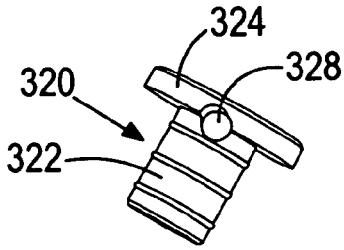

A drive pin 40 mounted eccentrically on a platform 42 which is rigidly attached to one end of the crankshaft 38 in order to form a crank. FIG. 12 shows a perspective view of the crank. The crank 40, 42, 38 is integrally formed in a one piece construction. Rotation of the crankshaft 38 causes the longitudinal axis 44 of the drive pin 40 to rotate about the longitudinal axis 46 of the crankshaft 38 in well known manner. The platform 42 comprises a semi-circular section 314 and a raised section 316 on which is mounted the drive pin 40. The mass of the semi-circular section 314 counteracts the forces applied to the crank due via the pin 40 when the crank rotates.

A tubular passageway 300 extends through the full length of the crank shaft 38 to allow the passage of air and lubricating grease through the length of the crank shaft 38, enabling them to more easily move within the upper housing 2. Similarly, a tubular passageway 302 extends through the full length of the drive pin 40, again to allow the passage of air and lubricating grease through the length of the drive pin 40, enabling them to more easily move within the upper housing 2. A lubrication groove 318 is formed in the raised section 316 which extends radially outwardly from the longitudinal axis 46 of the crank shaft 38 from the end of the raised section to the drive pin 40 as shown in FIG. 12. The function of the lubrication groove 318 is described in more detail below.

An oil cap 320, as shown in FIGS. 13A to 13G, clips into the end of the crank shaft 38 as shown n FIG. 9A. The oil cap 320 comprises a tubular body 322 and a flat end cap 324 attached to one end. The tubular body 322 has a passageway 326 through its length, its base 332 being open. The end cap 324 comprises a tubular passageway 328 which extends from one side of the perimeter of the end cap 324 to the passageway 326 within the tubular body 322. This provides a passageway from the edge of the end cap 324 to the base 332 of the tubular body 322 which allows the passage of lubricating oil through the oil cap 320.

The tubular body of the oil cap locates in the tubular passageway 300 of the crank shaft 38, the end cap 324 abutting against the end of the crank shaft. The oil cap 320 is orientated so that the tubular passageway 328 points towards the drive pin 40 and so that it points towards and is in line with the lubrication groove 318. An arrow 330 indicates the direction of the tubular passageway for ease of assembly.

A con rod 48 is rotationally attached at one of its ends to the drive pin 40 via drive bearings 334. The other end of the con rod 48 is pivotally attached to a piston 50 which is slideably mounted within a cylinder 52 rigidly mounted within the middle housing 504. Rotation of the crankshaft 38 results in a reciprocating movement of the piston 50 within the cylinder 52.

The rotational movement of the gears 102, 106, 110, the crank 38, 40, 42, the con rod 48 and piston 50 encourage lubricating oil to pass through the tubular passageway 300 of the crank shaft 38 and the tubular passageway of the drive pin 40 as will be described in more detail below.

Figure 9B:
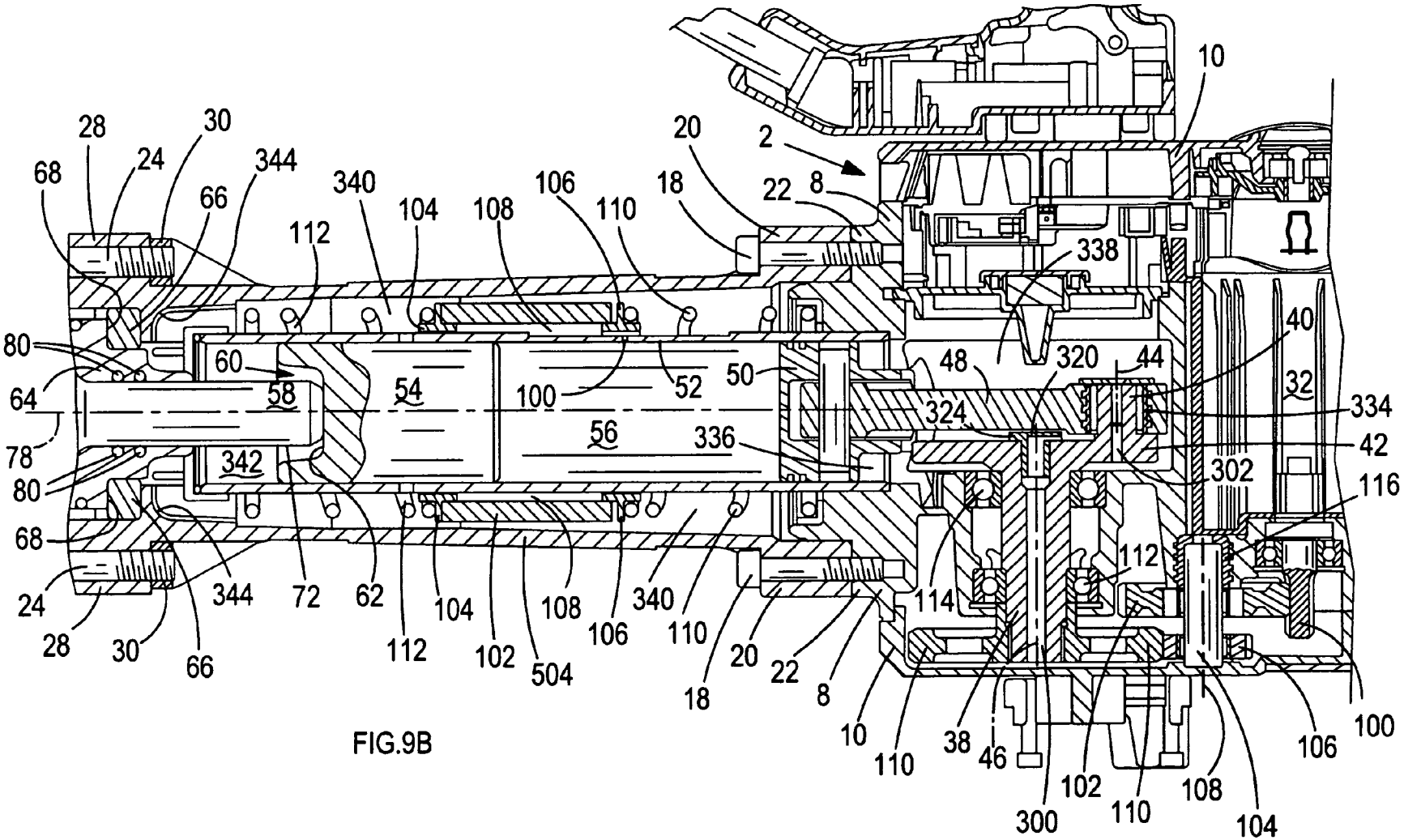
FIG. 9B shows a vertical cross section of the middle section of the pavement breaker) in the direction of Arrows A in FIGS. 8A and 8B.

A ram 54 is located within the cylinder 52 and is capable of freely sliding within the cylinder 52. Piston rings surround the piston 50 to prevent air within the cylinder passing the piston 50. Similarly, piston rings surround the ram 54 to prevent air within the cylinder passing the ram 54. Therefore, the reciprocating movement of the piston 50 reciprocatingly drives the ram 54 within the cylinder 52 via an air spring 56 formed between the piston 50 and ram 54. An air hole 100 is formed in the wall of the cylinder 52. Once the ram 54 has passed the air hole 100 travelling away from the piston 50, as shown in FIG. 9B, air is able to leave or enter the space within the cylinder 52 between the ram 54 and the piston 50. This effectively deactivates the air spring 56, allowing the ram 54 to then freely travel along the cylinder 52 and slide towards the beat piece 58. It strikes the beat piece 58 and then bounces back towards the piston. When the ram 54 has passed the air hole 100 travelling towards the piston 50, air can no longer leave or enter the space within the cylinder 52 between the ram 54 and the piston 50. As such, the air spring 56 is re-established, allowing the ram 54 to be reciprocatingly driven by the piston 50 via the air spring 56.

The ram 54, when reciprocatingly driven by the piston 50, repeatedly strikes a beat piece 58 which is supported by a beat piece support structure which is sandwiched between the upper end of the tool holder housing 502 and lower end of the middle housing 504. A recess 60 is formed in the lower end of the ram 54. The top end of the beat piece 58 is struck by the base 62 of the recess 60. This reduces the overall length of the striking mechanism whilst maximising the stroke length (the maximum axial distance travelled by the ram within the cylinder 52) of the ram 54.

The beat piece support structure comprises a shaped circular tubular metal support 64 having a tubular passageway, of uniform circular cross section, formed through its length. The lower end of the shaped circular tubular metal support 64 is located within a circular recess within the upper end of the tool holder housing 502. A rubber dampener 66 is sandwiched between a radial step 68 formed on the shaped circular tubular metal support 64 and the middle housing 504. A guide 70 is sandwiched between the tool holder housing 502 and the shaped circular tubular metal support 64.

Figure 10:
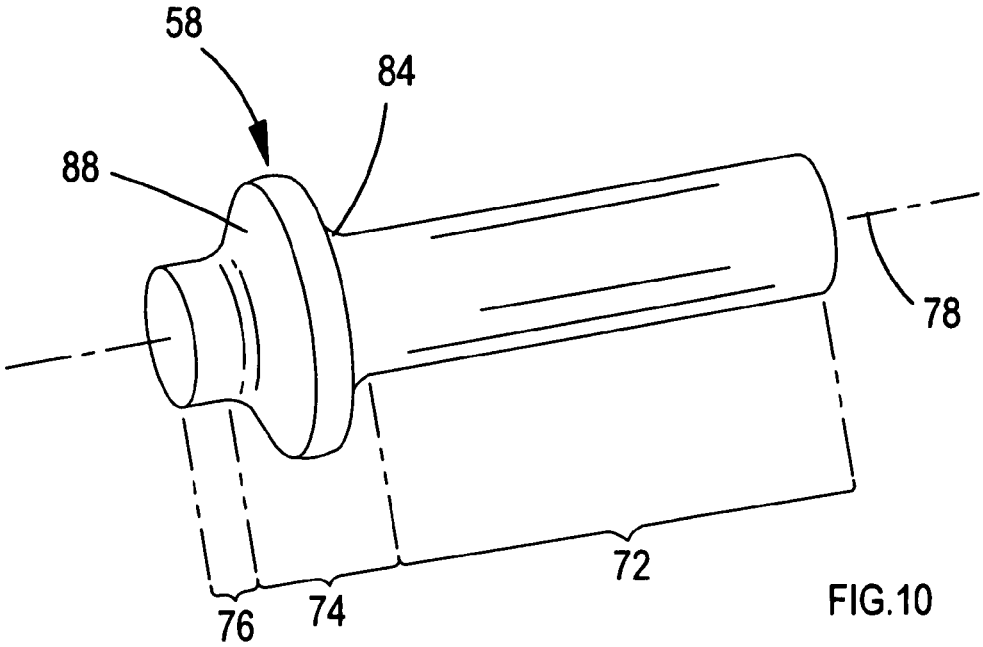
FIG. 10 shows the beat piece according to the present invention.

The beat piece 58 comprises a cylindrical shank 72, a radial bulge 74 and a nose 76 as best seen in FIG. 10. The radial shank 72 locates within the tubular passageway of the shaped circular tubular metal support 64 and is capable of sliding along its longitudinal axis 78 within the tubular passageway. Seals 80 are provided within the wall of the tubular passageway which engage with the sides of the cylindrical shank 72 of the beat piece 58 to prevent dust etc from passing through the tubular passageway of the shaped circular tubular metal support 64 into the middle housing 504.

Figure 9C:
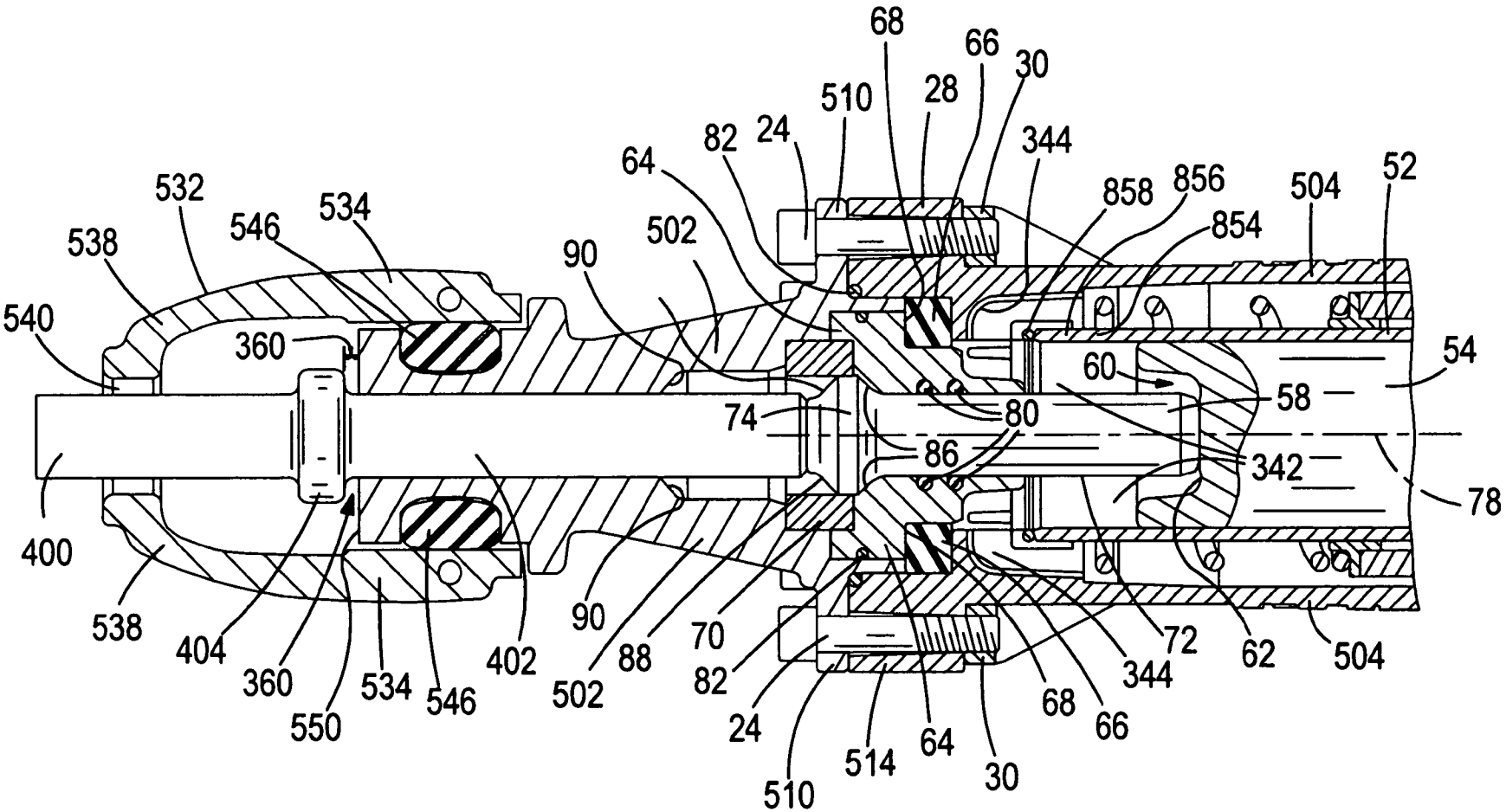
FIG. 9C shows a vertical cross section of the lower end of the pavement breaker) in the direction of Arrows A in FIGS. 8A and 8B, FIGS. 9A, 9B and 9C showing a vertical cross section of the pavement breaker according to the present invention (excluding a handle) when combined.

The rear ward (upward) movement (to the right in FIGS. 9B and 9C) is limited by the rear shoulder 84 of the radial bulge 74 engaging with an angled face 86 of the shaped circular tubular metal support 64. The forward (downward) movement (to the left in FIGS. 9B and 9C) is limited by the front shoulder 88 of the radial bulge 74 engaging with an angled face 90 formed within of the tool holder housing 502.

The tool holder housing 502 forms the main support structure of the tool holder in which can be held a tool, such as a chisel. The ram 54, when reciprocatingly driven by the piston 50, repeatedly strikes the end of the shank 72 of the beat piece 58, the nose 76 of which, in turn, repetitively strikes the end of the tool held within the tool holder.

This pavement breaker comprises a dampening mechanism which counteracts the vibration generated by the operation of the pavement breaker. The dampening mechanism comprises a tubular counter mass 102 of circular cross section which surrounds the cylinder 52. The tubular counter mass 102 is made from a magnetic material (or, alternatively, includes a permanent magnet built into the counter mass) for purposes described in more detail below. The tubular counter mass 102 is slideably mounted on the cylinder 52 via two guide rings 104, 106. The first guide ring 104 is rigidly attached to the lower end of the tubular counter mass 102, the second guide ring 106 is rigidly attached to the upper end of the tubular counter mass 102. The two guide rings 104, 106 are mounted directly on the cylinder and side along the surface of cylinder 52. The inner diameter of the tubular counter mass 102 is greater than that of the outer diameter of the cylinder 52. This results in a space 108 being formed between the tubular counter mass 102 and the outside of the cylinder 52. The guide rings 104, 106 maintain the size of this space 108, ensuring that the counter mass 102 does not come into contact with the cylinder 52. A lubricating oil surrounds the cylinder 52 and reduces friction between the guide rings 104, 106 and the outside surface of the cylinder 52 as the guide rings 104, 106 slide along the surface.

The tubular counter mass 102 is biased to a central position between two helical springs 110, 112 which surround the cylinder 52. The first helical spring 110 is sandwiched between the second guide ring 106 and the central clam shell 8 of the upper housing 2. The second helical spring 112 is sandwiched between the first guide ring 104 and a recess formed within the middle housing 502.

As the pavement breaker operates, it generates vibration. The vibration causes the counter mass 102 to oscillate backwards and forwards along the cylinder 52. The strength of the two springs 110, 112 and the weight of the mass 102 are arranged so that the counter mass 102 vibrates out of phase with the rest of the pavement breaker, the resulting motion reducing the size of vibration experienced by the body of the pavement breaker and thus producing a dampening effect.

The lubrication system of the pavement breaker will now be described.

In order for the pavement breaker to operate efficiently, its internal components must be lubricated using a lubrication oil which is capable of freely flowing internally around the component parts of the pavement breaker to reduce friction, wear and tear. One of the problems of pavement breakers is to ensure that there is a dispersement of the lubricating oil across the component parts. The present pavement breaker utilises the movement of its component parts to distribute the lubricating oil to the areas where it is required.

When the pavement breaker is operated, the electric motor 32 rotating drives the crankshaft 38 via the gears 102, 106, 110 which inturn reciprocatingly drives the piston 50 in well known manner. As the piston 50 reciprocatingly moves within the cylinder 52, the size of the space 336 behind the piston 50 continuously fluctuates. As the volume changes, the amount of air capable of being located within the space 336 in the cylinder 52 behind the piston 50 also continuously alters. As such, air is sucked from inside the upper housing 2 into the top of the cylinder 52 behind the piston 50 as the volume of the space 336 increases and is blown out from the top of the cylinder 52 into the upper housing 2 as the volume of the space 336 decreases. This results in large air movements within the upper housing 2.

Furthermore, as the pavement breaker is operated, the tubular counter mass 102 slides in an oscillating fashion along the outside of the cylinder 52 to perform its dampening function.

The lubricating oil coats all of the internal parts of the pavement breaker including the crank shaft 38, the drive pin 40, the con rod 48, the rear of the piston 50, the outside of the cylinder 52, the counter mass 102 and the springs 110, 112. The large air movements within the upper housing 2 caused by the reciprocating movement of the piston 50 within the cylinder 52 causes air, and oil entrained within the air, typically in the form of a spray, to move through the tubular passageway 300 of the crank shaft 38 in alternate directions as the air is repetitively drawn into and expelled from the space 336 in the cylinder 52 behind the piston 50. The generation of oil spray can be caused by the movement of the crank 38, 40, 42, the con rod 48, the gears 102, 106, 110 and the piston 50. The tubular passageway 300 of the crank shaft 38 enable easy movement of air and lubricating oil within the upper housing as the air fluctuates due to the reciprocating piston 50.

One important component which requires lubrication is that of the drive bearings 334 between the end of the con rod 48 and the drive pin 40. Lubrication is provided by the provision of the oil cap 320 and the lubrication groove 318.

When air and entrained lubricating oil is drawn out of the tubular passageway 300 of the crank shaft 38 towards the space 336 behind the piston 50 (due to air being sucked into the space 336 in the cylinder 52 behind the piston 50), the air and entrained lubricating oil pass from the tubular passageway 300 of the crank shaft 38 through the oil cap 320 into the area 338 adjacent the con rod 48. In order to pass through the oil cap 320, it must pass through the tubular passageway 328 of the end cap 324 of the oil cap 320. As the crank shaft 38 is rotating, the oil cap 320, and thus the end cap 324 with the tubular passageway 328 is also rotating. Therefore, entrained lubricating oil is expelled from the tubular passageway radially outwards from the longitudinal axis 46 of the crank shaft 38 due to centrifugal forces. As the tubular passageway 328 points towards the drive pin 40 so that it points towards and is in line with the lubrication groove 318, the radially expelled lubricating oil is directed towards and enters into the lubricating groove 318. The lubricating oil then continues along the lubricating groove 318 due to centrifugal forces until it meets with the base of the drive pin 40 where it engages with the drive bearings 334. As such, constant lubrication of the drive bearings 334 is ensured.

When air and entrained lubricating oil forced into the tubular passageway 300 of the crank shaft 38 from the space 336 behind the piston 50 (due to air being expelled from the space 336 in the cylinder 52 behind the piston 50), the air and entrained lubricating oil pass from the area 338 adjacent the con rod 48 through the oil cap 320 into the tubular passageway 300 of the crank shaft. However, lubricating oil already located in the lubrication groove 318 is not drawn away from the drive pin 40 due to the centrifugal forces acting on it due to the rotation of the crank shaft 38.

The oscillating movement of the counter mass 102 also causes air movement within the space 340 around the cylinder 52 within the middle housing 502. Furthermore, the oscillating movement of the counter mass 102 causes the oil to become a spray. The air movement causes the generated lubrication oil spray to circulate within the space 340 within middle housing 502 surrounding the cylinder 52.

Another important area which requires lubrication is the lower cylinder space 342 below the ram 54 but above the beat piece support structure. In order to achieve this, a curved passageway way 344 is formed in the base of the middle housing 504 which directs air and entrained lubricating oil into the lower cylinder space 342. As the counter mass 102 moves downwardly towards the tool holder, it pushes air and entrained lubricating oil into the curved passageway 344 which directs into the lower cylinder space 342 due to it shape. As the counter mass 102 moves upwardly away from the tool holder, it draws air and entrained lubricating oil out of the lower cylinder space 342 through the curved passageway 344. The movement of the air and entrained lubricating oil into and out of the lower cylinder space 342 is also assisted by the movement of the ram 54 within the cylinder 52 increasing or decreasing the lower cylinder space 342, causing pressure fluctuations resulting in air movement. The movement of the ram 54 is out of phase to that of the counter mass 102 such that their respective movements co-operate in the movement of air and entrained lubricating oil into and out of the lower cylinder space 342.

Channels (not shown) are formed between the space 340 around the cylinder 52 within the middle housing 504 and the area 338 adjacent the con rod 48 to enable the passage of air and entrained lubricating oil between the two.

It should be noted that the movement of the piston 50 and ram 54 are synchronised, though not necessarily in phase, via the air spring 56, and that the movement of the counter mass 102 is synchronised with the ram 54 and piston 50, though not necessarily in phase with either. As such, there is an overall co-ordination of the movement of air, and any entrained lubrication oil, within the pavement breaker.

The gears 102, 106, 110 may have an addition thick grease as a lubricant which is applied to the components when assembled and reapplied during maintenance. This thick grease is too viscous to be moved by the air fluctuations within the pavement breaker. However, over time, there will be some mixing of the lubricating oil and the thick grease as the lubricating oil is circulated within the pavement breaker.

As the pavement breaker is used, component parts will inevitably wear resulting in metal splinters being generated. These will be transported around the inside of the pavement breaker by the movement of the air and entrained lubricating oil. These potentially could cause further damage. By manufacturing the counter mass 102 from magnetic material, as the metal splinters pass the counter mass 102, they would be attracted to it due to magnetic forces, and attach them selves to the counter mass 102. As such, the metal splinters become trapped preventing them from causing any damage.

The tool holder will now be described.

The tool holder 94 is similar to the prior art one described above with reference to FIGS. 1 to 6. Where the same features are present in the present embodiment of tool holder as that in the prior art tool holder described above with reference to FIGS. 1 to 6, the same reference numbers have been used.

It should be noted that in FIGS. 14A to 14D, 15A to 15E, 16A to 16D and 17A to 17D, the beat piece support structure, together with the beat piece, have been omitted for clarity.

FIGS. 14A to 14D and FIGS. 15A to 15E show the tool holder only, when it used to hold a tool with the first type of connection mechanism using the U shaped clamp 532 to engage with the rib 404 of the tool. The mechanism by which the tool is secured into the tool holder is the same as that of the prior design as described above with reference to FIGS. 1 to 6.

FIGS. 14A to 14D show the tool holder holding the connection end 402 of the tool within the tool holder. The hook 540 surrounds the shank 400 of the tool and is so positioned that it prevents the connection end 402 of the tool from sliding out of the recess 520 of the tool holder by the hook 540 preventing the rib 404 from sliding past the hook 540. The angular position of the U shaped clamp 532 is maintained by the flat locking faces 552 being engaged with the flat holding surfaces 554. In order to release the chisel from the tool holder, the U shaped clamp 532 is pivoted about the longitudinal axis 530 of the metal rod 524. As the U shaped clamp 532 is pivoted, the flat locking faces 552 disengage from the flat holding surfaces 554 in the same manner as the prior art design described above.

In the prior art design of tool holder, the U shaped clamp 532 is free to pivot once the flat locking faces 552 are disengage from the flat holding surfaces 554. This results in the problem that the U shaped clamp 532 can freely move whilst an operator is removing or inserting a tool into the tool holder.

In the present embodiment of tool holder, the two rings 534 of the U shaped clamp 532 comprise storage faces 350. In order to remove or insert a tool into the tool holder, the U shaped clamp 532 is pivoted to a released position where the hook 540 is located away from the rib 404 on the tool as shown in FIGS. 15A to 15E. The storage faces 350 engage with the flat holding surfaces 554 of the tool holder to lock the U shaped clamp 532 in a released position as shown in FIG. 15A to 15E. This prevents the problem of the U shaped clamp 532 pivoting whilst an operator is removing or inserting a tool into the tool holder. Once the tool is inserted, the U shaped clamp 532 can be pivoted back to its locking position where the flat locking faces 552 engage the flat holding surfaces 554.

The mechanism by which the storage faces 350 engage and disengage with the flat holding surfaces 554 to hold the U shaped clamp 532 stationary is the same as that by which the first locking faces 552 engage with the flat holding surfaces 554 to hold the U shaped clamp 532 stationary.

Figure 14A:
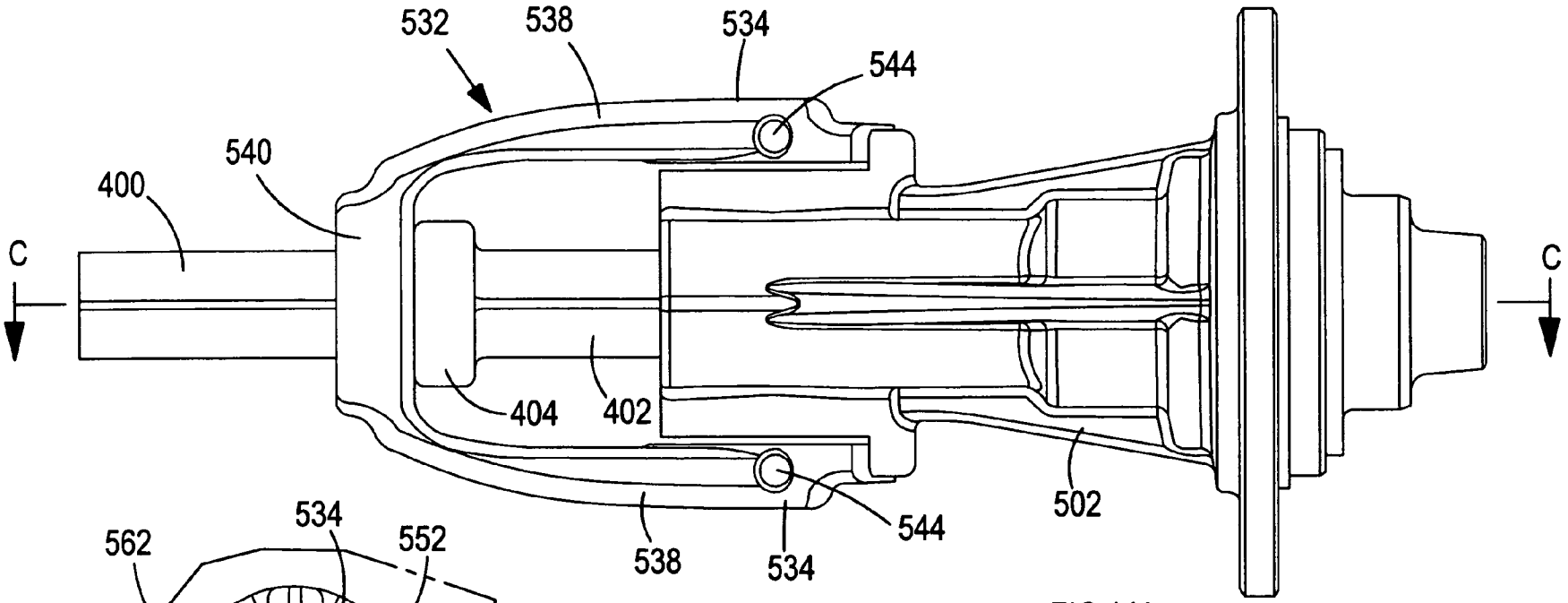
FIG. 14A shows a side view of the tool holder with the U shaped clamp in a first position.
Figure 14B:
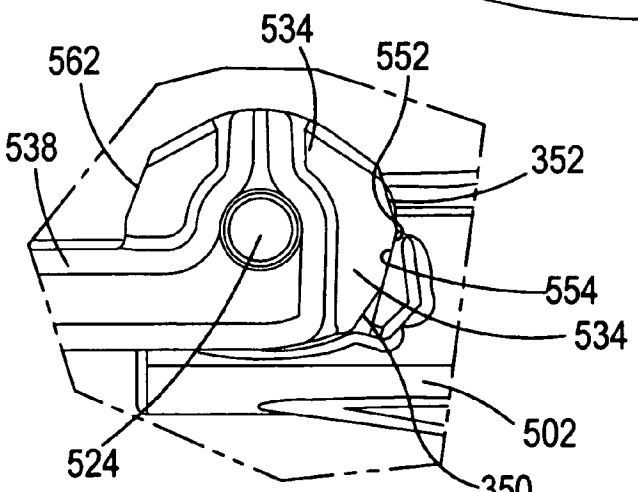
FIG. 14B shows a side view of the two ends of the U shaped clamp with the U shaped clamp in the first position.
Figures 14C, 14D:
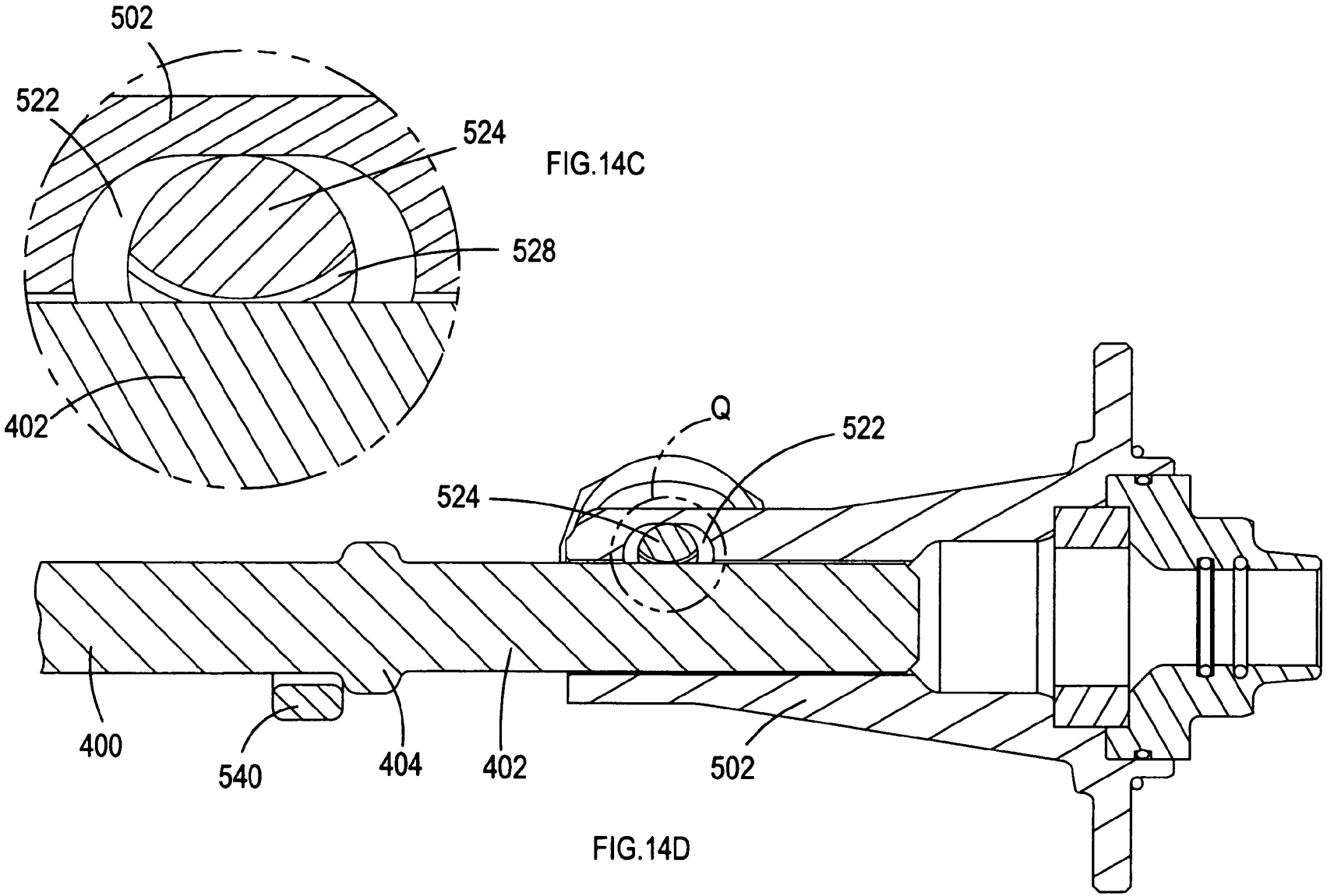
FIG. 14C shows a close up, indicated by section Q in FIG. 14D, of the vertical cross section of the metal rod within the oval tubular passageway.
FIG. 14D shows a vertical cross section of the tool holder in the direction of Arrows C in FIG. 14A.
Figure 15A:
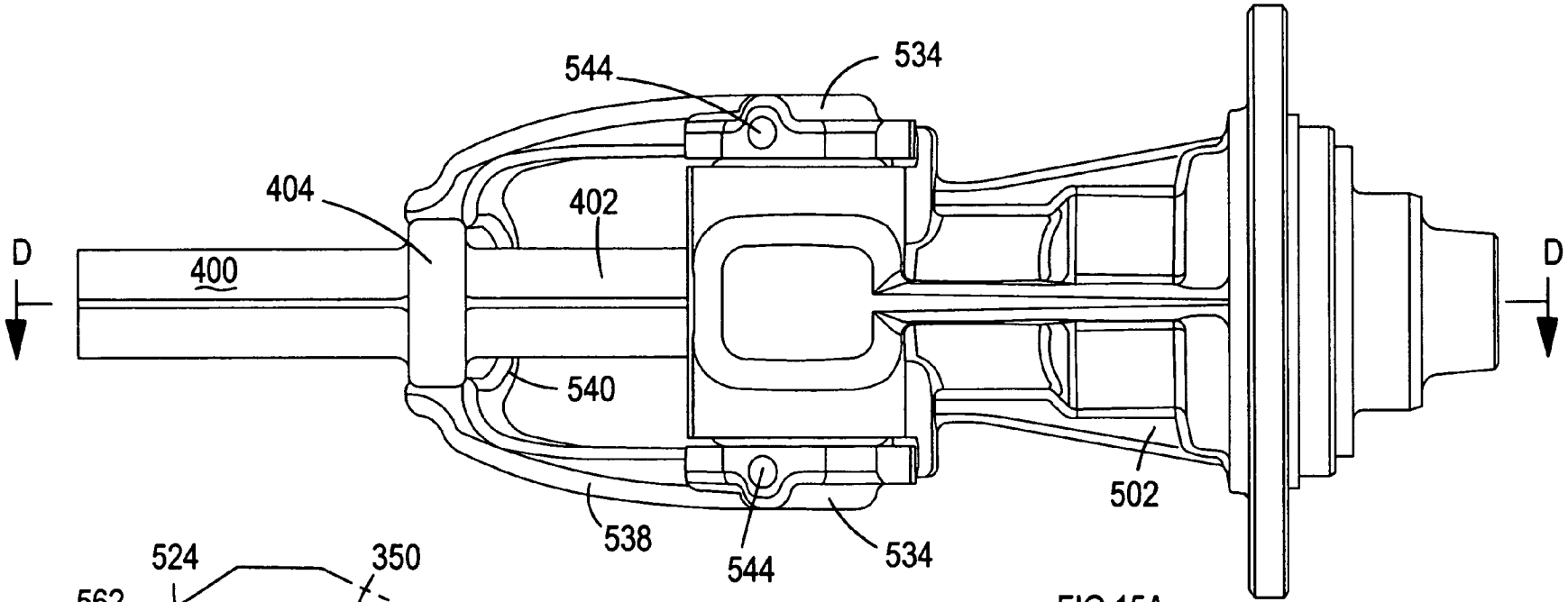
FIG. 15A shows a side view of the tool holder with the U shaped clamp in a second position.
Figure 15B:
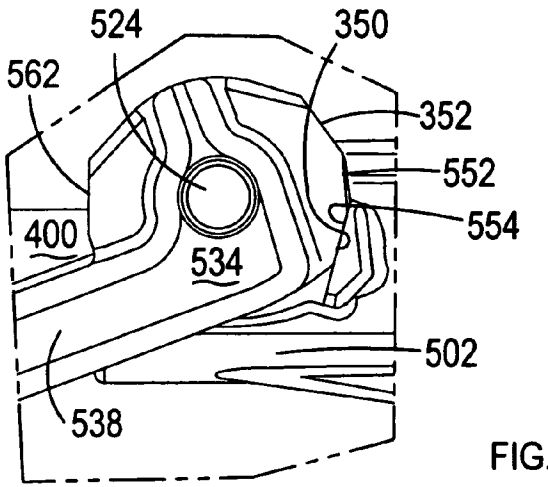
FIG. 15B shows a side view of the two ends of the U shaped clamp with the U shaped clamp in the second position.
Figure 15E:
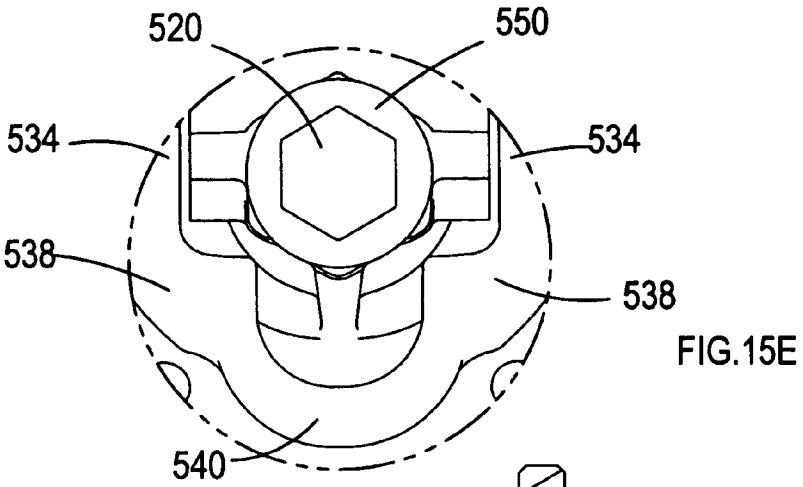
FIG. 15E shows a front view in the direction of Arrows E in FIG. 15D of the tool holder excluding the tool.
Figure 15C:
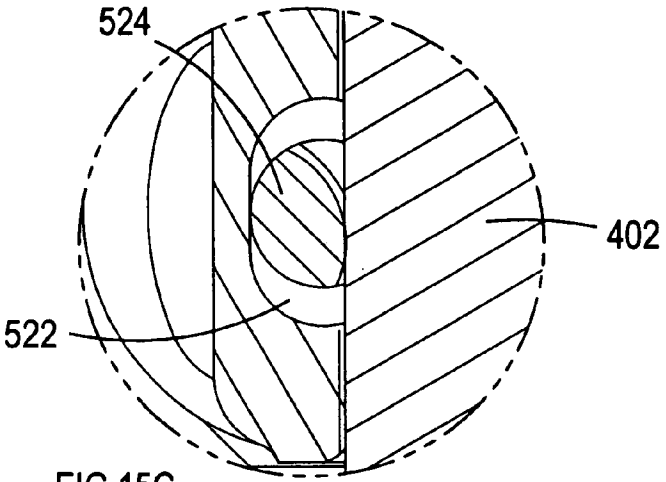
FIG. 15C shows a close up of the vertical cross section of the metal rod within the oval tubular passageway, indicated by section P in FIG. 15D.
Figure 15D:
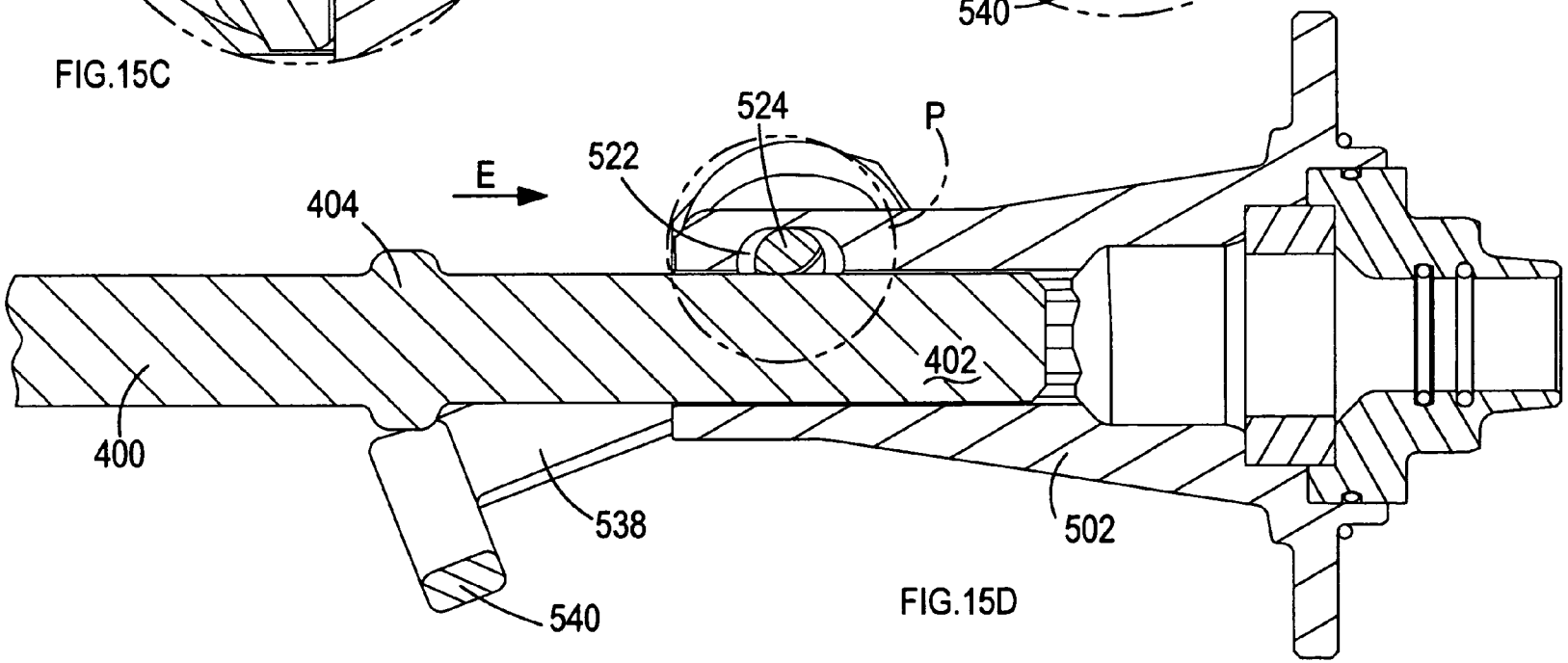
FIG. 15D shows a vertical cross section of the tool holder in the direction of Arrows D in FIG. 15A.
Figure 16A:
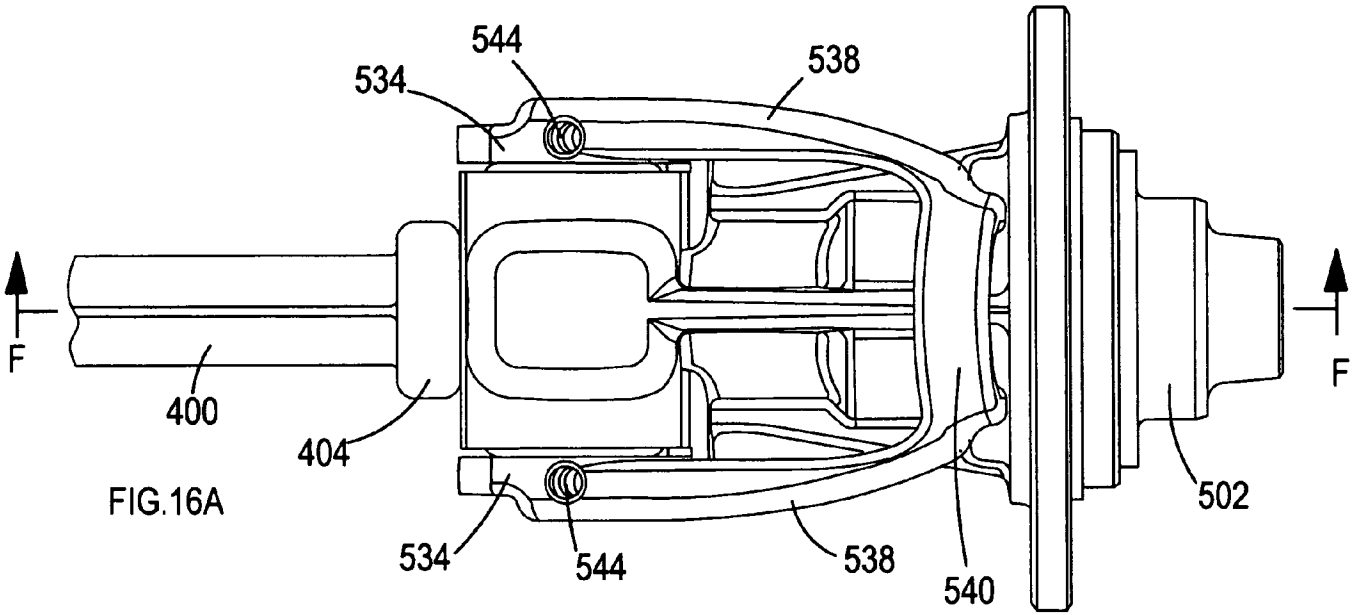
FIG. 16A shows a side view of the tool holder with the U shaped clamp in a third position.
Figure 16C:
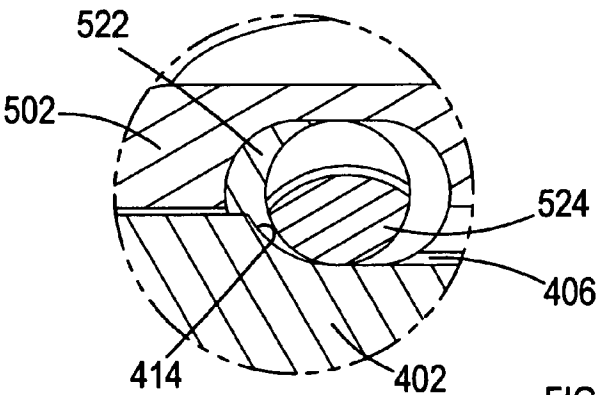
FIG. 16C shows a close up of the vertical cross section of the metal rod within the oval tubular passageway indicated by section R in FIG. 16D.
Figure 16B:
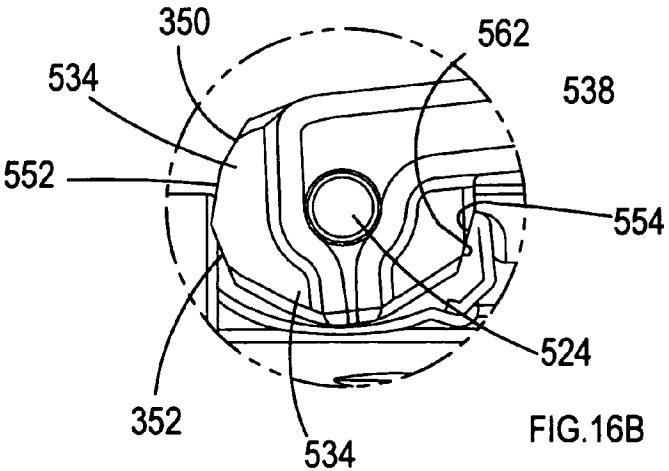
FIG. 16B shows a side view of the two ends of the U shaped clamp with the U shaped clamp in the third position.
Figure 16D:
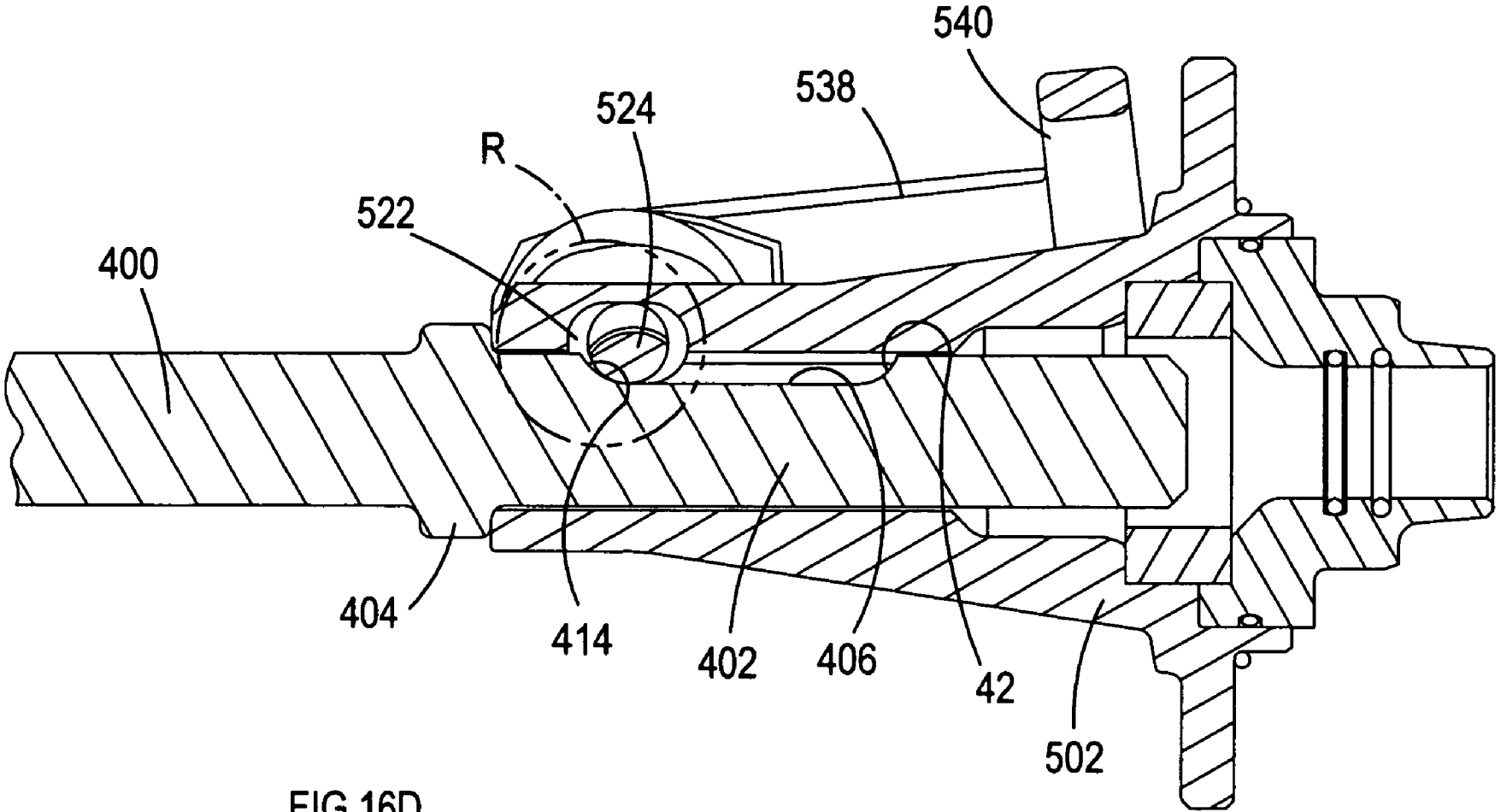
FIG. 16D shows a vertical cross section of the tool holder in the direction of Arrows F in FIG. 16A.
Figure 17A:
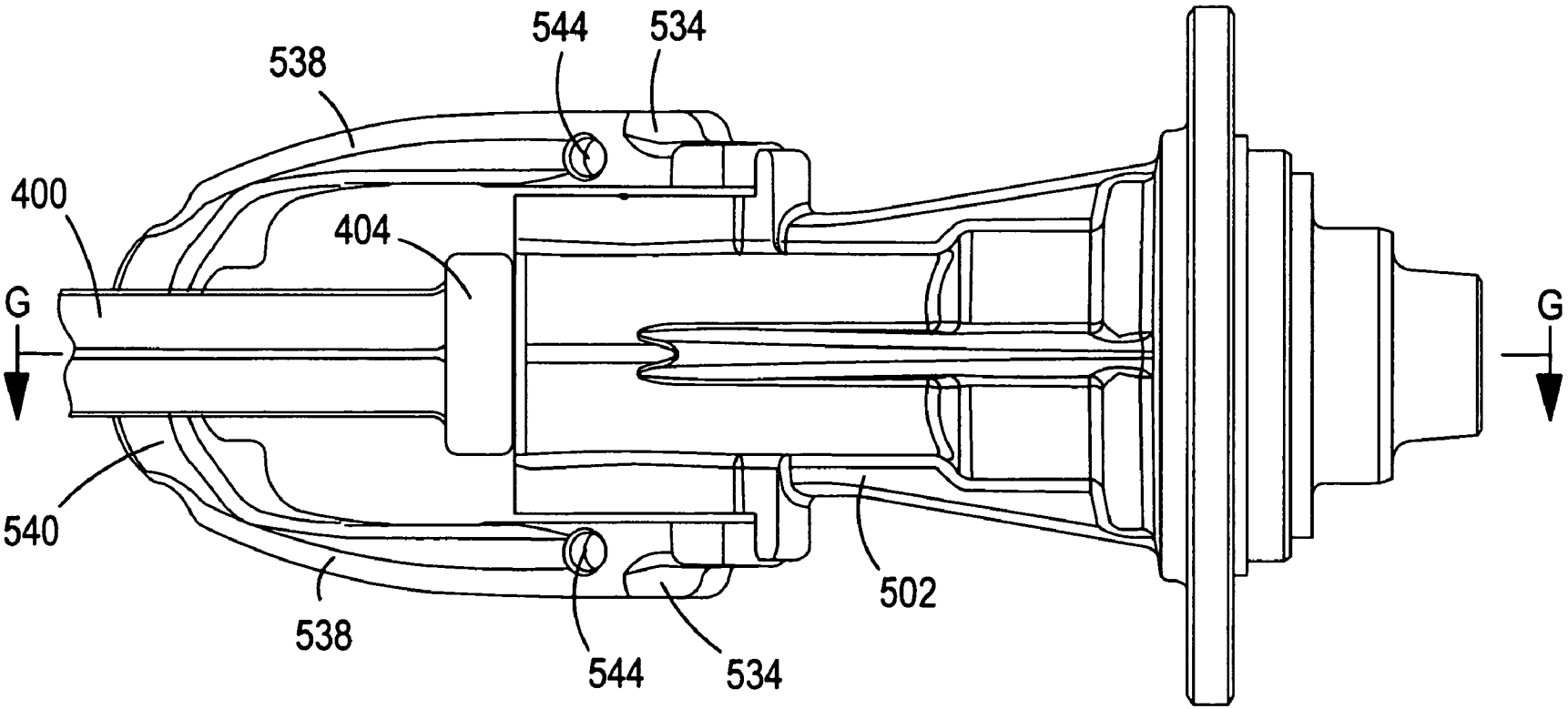
FIG. 17A shows a side view of the tool holder with the U shaped clamp in a fourth position.
Figure 17C:
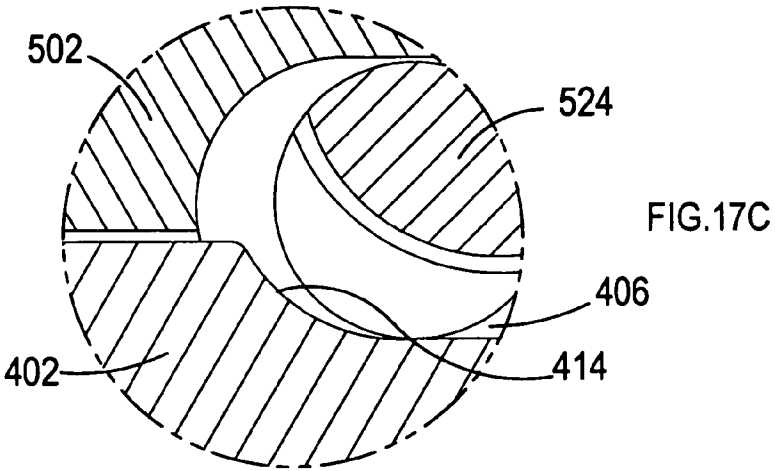
FIG. 17C shows a close up of the vertical cross section of the metal rod within the oval tubular passageway indicated by section S in FIG. 17D.
Figure 17B:
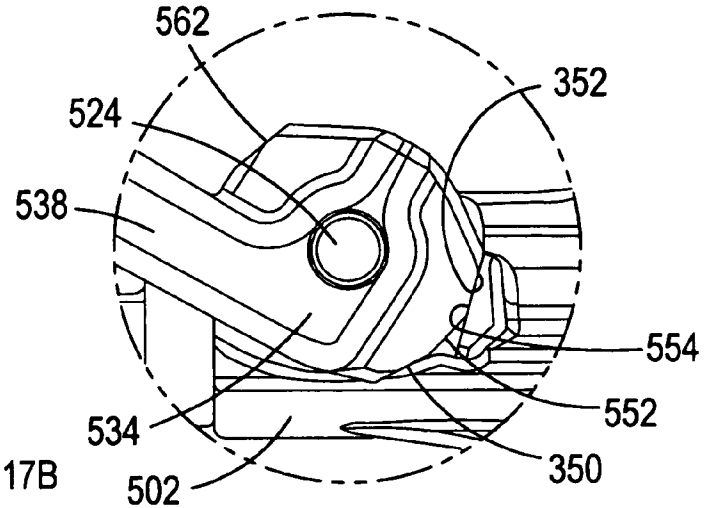
FIG. 17B shows a side view of the two ends of the U shaped clamp with the U shaped clamp in the fourth position.
Figure 17D:
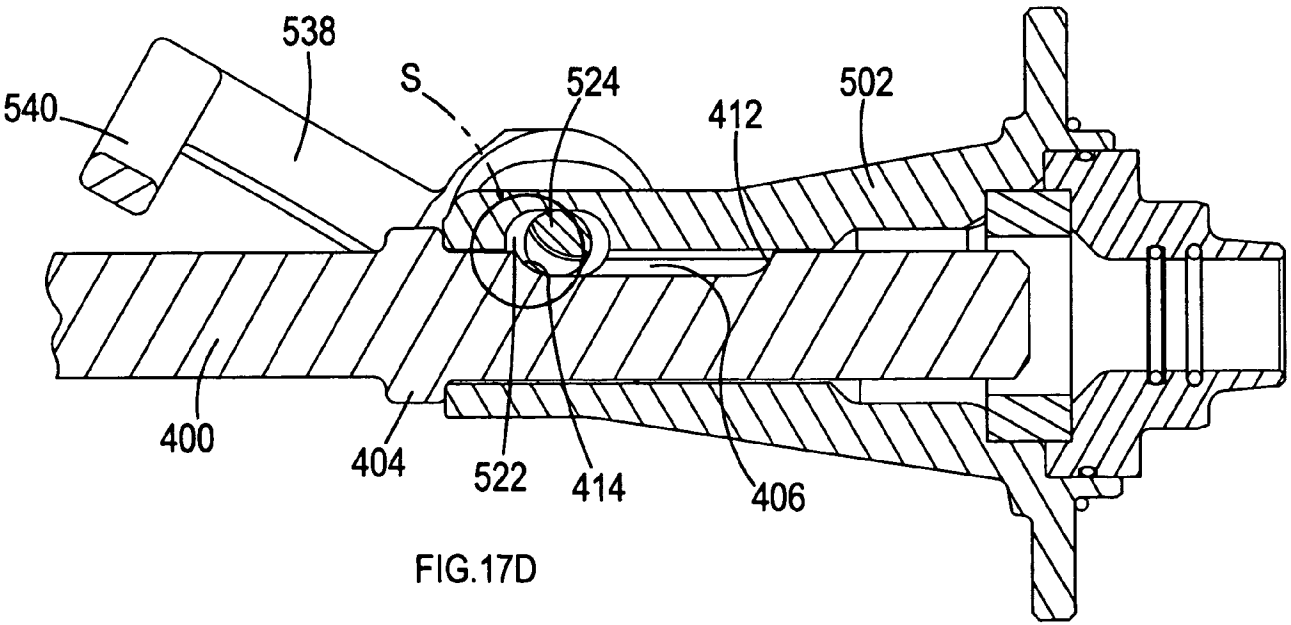
FIG. 17D shows a vertical cross section of the tool holder in the direction of Arrows G in FIG. 17A.

It should be noted that whilst the U shaped clamp 532 is either in the locked position (see FIG. 14D) or released position (see FIG. 15D), the metal bar 524 does not interfere with the connection end 402 of the tool (see FIGS. 14C and 15C).

FIGS. 16A to 16D and FIGS. 17A to 17D show the tool holder when it used to hold a tool with the second type of connection mechanism using the metal rod 524 to engage with the recess 406 of the tool. It should be noted that the drawings show a tool having a rib 404 as well as a recess 406. The rib 404 plays no part in securing the tool into the tool holder when the metal rod 524 is utilised. The mechanism by which the tool is secured into the tool holder is the same as that of the prior design as described above with reference to FIGS. 1 to 6.

FIGS. 16A to 16D show the tool holder holding the connection end 402 of the tool within the tool holder. The metal rod 524 is located within the recess 406 of the tool and is so positioned that it prevents the connection end 402 of the tool from sliding out of the recess 520 of the tool holder by the metal rod 524 preventing the edges 412, 414 of the recess 406 from sliding past the metal bar 524. The angular position of the U shaped clamp 532 is maintained by the second flat locking faces 562 being engaged with the flat holding surfaces 554. In order to release the chisel from the tool holder, the U shaped clamp 532 is pivoted about the longitudinal axis 530 of the metal rod 524. As the U shaped clamp 532 is pivoted, the second flat locking faces 562 disengage from the flat holding surfaces 554.

In the prior art design of tool holder, the U shaped clamp 532 is free to pivot once the second flat locking faces 562 are disengaged from the flat holding surfaces 554. This results in the problem that the U shaped clamp 532 can move whilst an operator is removing or inserting a tool into the tool holder.

In the present embodiment of tool holder, the two rings of the U shaped clamp 532 comprise secondary storage faces 352. In order to remove or insert a tool into the tool holder, the U shaped clamp 532 is pivoted to a position where the circular groove 528 of the metal bar 524 faces towards the recess 406 on the chisel as shown in FIGS. 17A to 17D. The secondary storage faces 352 engage with the flat holding surfaces 554 of the tool holder to lock the U shaped clamp 532 in a released position as shown in FIG. 17A to 17D. This prevents the problem that the U shaped clamp 532 pivoting whilst an operator is removing or inserting a tool into the tool holder. Once the tool is inserted, the U shaped clamp 532 can be pivoted back to its locking position where the second flat locking faces 562 engage the flat holding faces 554.

The mechanism by which the secondary storage faces 352 engage and disengage with the flat holding faces 554 to hold the metal rod 352 stationary is the same as that by which the second locking faces 562 engage with the flat holding faces 554 to hold the U shaped clamp 532 stationary.

It will be noted that in when the U shaped clamp 532 is in the positions shown in FIGS. 14A to 14D and FIG. 15A to 15E, the metal bar 524 does not interfere with the insertion of the connection end 402 of a tool. However, these positions can not be utilised when a tool with the second type of connection mechanism is to be held by a tool holder utilising the metal bar 524. This is because the U shaped clamp 532 is located on the wrong side of the tool in the released position to the that of the locked position (shown in FIG. 16A to 16D). It would be prevented from pivoting to the position shown in FIG. 16A to 16D, as the hook 540 of the U shaped clamp 532 could not pass the shank 400 of the tool.

The wear indicator of the nose 76 of the beat piece 58 will now be described.

During the operation of the pavement breaker, the nose 76 of the beat piece 58 repetitively strikes the connection end 402 of the tool. The beat piece suffers from wear, in particular, the nose 76 of the beat piece wears down, it length reducing as it wears. As such, a beat piece 58 having a nose 76 of increased length has been provided to accommodate the wear experienced by the nose 76. However, it remains important to be able to tell when the nose 76 is sufficiently worn.

When the pavement breaker is not in use, the beat piece 58 is capable of freely sliding within the beat piece support structure, its movement being limited by the rear shoulder 84 of the radial bulge 74 engaging with the rear angled face 86 and the front shoulder 88 engaging with the forward angled face 90.

When a tool is slid into the tubular recess 520 of the tool holder, the end of the connection end 402 of the tool will engage the nose 76 of the beat piece 58. As the connection end is further inserted into the tubular recess 520, it pushes the beat piece 58 rearward (to the right in FIG. 9C), until the rear shoulder 84 of the radial bulge 74 of the beat piece 58 engages with the rear angled face 86 of the beat piece support structure. At which point, the beat piece 58 is prevented from moving further in a rear ward direction. This in turn prevents the connection end 402 from being inserted further into the tubular recess 520 of the tool holder.

A tool having the first type of connection mechanism comprises a rib 404. The distance between the rib 404 and the end of the connection end 402 of the tool is a predetermined standard distance. The dimension of the tool holder, the beat piece 58 (unworn), the beat piece support structure are arranged so that, as the connection end 402 pushes the beat piece 58 rearward, when the rear shoulder 84 of the radial bulge 74 of the beat piece 58 engages with the rear angled face 86 of the beat piece support structure, a small distance 360 exists between the rib 404 and the nose 550 of the tool holder housing (see FIG. 9C). As the beat piece 58 is prevented from moving further, the tool can not be inserted further into the tool holder, thus the rib 404 can not be moved closer to the nose 550 of the tool holder housing.

As the length of the nose 76 of the beat piece wears away, the distance between the rib 404 and the nose 550 of the tool holder housing reduces when the tool is use to push the beat piece 58 rearward in the manner described above. The small distance (360) (created when a beat piece having an unworn nose 76 is located within the pavement breaker) is less than the length of the unworn nose 76 of the beat piece 58. Once the nose 76 of the piece 58 has become sufficiently worn due to use, its length will be so reduced that the rib 404 of a tool can engage with the nose 550 of the tool holder housing. This will then indicate to the operator that the beat piece 58 is sufficiently worn to require replacing. This provides a wear indicator for the beat piece 58 which is enclosed within the beat piece support structure inside the pavement breaker and therefore not easily accessible for inspection.

Numerous modifications may be made to the exemplary implementations described above. These and other implementations are within the scope of the following claims.

The invention claimed is:

1. A powered hammer comprising:

a housing;

a tool holder coupled to the housing and configured to hold a tool;

a motor within the housing;

a cylinder disposed within the housing;

a piston slideably mounted within the cylinder;

a drive mechanism that converts rotary output of the motor into a reciprocating motion of the piston, the drive mechanism including a crank shaft rotationally driven by the motor, a drive pin eccentrically mounted on the crank shaft, and a connecting rod with a first end connected to the drive pin and a second end connected to the piston;

a ram slideably mounted forward of the piston that is reciprocatingly driven by the piston;

a beat piece slideably mounted forward of the ram, the beat piece being repetitively struck by the reciprocating ram and which in turn repetitively strikes an end of the tool when held in the tool holder to transfer the momentum of the ram to the tool, lubrication fluid covering at least part of the drive mechanism, a rear piston chamber formed within an end of the cylinder, rearward of the piston, the volume of which repetitively changes as the piston moves within the cylinder, causing air within the housing to be at least one of drawn into and blown out of the rear piston chamber, the movement of air causing the lubrication fluid to move within the housing; and a longitudinal passageway defined in at least one of the crank shaft and the drive pin to enable passage of air and the lubricating fluid to assist in movement of the lubrication fluid within the housing.

2. The powered hammer of claim 1 wherein, as air is drawn into the rear piston chamber, air and lubrication fluid move through the longitudinal passageway in one direction, and as air is blown out of the rear piston chamber, air and lubrication fluid move through the longitudinal passageway in an opposite direction.

3. The powered hammer of claim 1 wherein the con rod is connected to the drive pin via a bearing, and further comprising a crank shaft fluid guide connected to an end of the longitudinal passageway to direct the lubricating fluid towards the bearing when the lubricating fluid exits the longitudinal passageway.

4. The powered hammer of claim 3 further comprising a guide mechanism, wherein the crank shaft fluid guide directs lubricating fluid toward the guide mechanism.

5. The powered hammer of claim 4 wherein the movement of the lubricating fluid from the crank shaft fluid guide to the guide mechanism is at least partially due to the movement of air within the housing.

6. The powered hammer of claim 4 wherein the movement of the lubricating fluid from the crank shaft guide to the guide mechanism is at least partially due to a centrifugal force acting on that lubrication fluid generated by the rotation of the crank shaft.

7. The powered hammer of claim 6 wherein the guide mechanism directs the lubricating fluid towards the bearing, the movement of that lubrication fluid being caused by the centrifugal force.

8. The powered hammer of claim 4 wherein the guide mechanism comprises a groove formed in a support structure.

9. The powered hammer of claim 8 wherein the groove extends away from a base of the drive pin toward an axis of rotation of the crank shaft.

10. The powered hammer of claim 3 wherein the crank shaft fluid guide comprises a plastic cap that clips into an end of the longitudinal passageway.

11. A powered hammer comprising:

a housing;

a tool holder coupled to the housing and configured to hold a tool;

a motor within the housing;

a cylinder disposed within the housing;

a piston slideably mounted within the cylinder;

a drive mechanism that converts rotary output of the motor into a reciprocating motion of the piston, the drive mechanism including a crank shaft rotationally driven by the motor, a drive pin eccentrically mounted on the crank shaft via a support structure, and a connecting rod with a first end connected to the drive pin via a bearing and a second end connected to the piston;

a ram slideably mounted forward of the piston that is reciprocatingly driven by the piston;

a beat piece slideably mounted forward of the ram, the beat piece being repetitively struck by the reciprocating ram and which in turn repetitively strikes an end of the tool when held in the tool holder to transfer the momentum of the ram to the tool, lubrication fluid covering at least part of the drive mechanism, wherein movement of the lubrication fluid is at least in part caused by a centrifugal force generated by rotation of the crank shaft; and a guide mechanism configured to direct the movement at least a portion of the lubrication fluid toward the bearing.

12. The powered hammer of claim 11 wherein the guide mechanism comprises a groove formed in the support structure.

13. The powered hammer of claim 12 wherein the groove extends away from a base of the drive pin toward an axis of rotation of the crank shaft.

14. The powered hammer of claim 11, further comprising a rear piston chamber formed within an end of the cylinder, rearward of the piston, the volume of which repetitively changes as the piston moves within the cylinder, causing air within the housing to be at least one of drawn into and blown out of the rear piston chamber, the movement of air causing the lubrication fluid to move within the housing.

15. The powered hammer of claim 14, further comprising a passageway defined in at least one of the crank shaft and the drive pin to enable passage of air and the lubricating fluid to assist in movement of the lubrication fluid within the housing.

16. The powered hammer of claim 15, wherein the movement of the lubricating fluid from the crank shaft fluid guide to the guide mechanism is at least partially due to the movement of air within the housing.

* * * * *